US007279846B2

(12) United States Patent
Gofuku et al.

(10) Patent No.: US 7,279,846 B2
(45) Date of Patent: Oct. 9, 2007

(54) IMAGE DISPLAY APPARATUS

(75) Inventors: Ihachiro Gofuku, Chigasaki (JP); Masaru Kamio, Sagamihara (JP); Hisanori Tsuda, Atsugi (JP); Yasue Sato, Machida (JP); Yoshiyuki Shimada, Fukaya (JP); Hiromasa Mitani, Hiratsuka (JP); Kazuyuki Seino, Fukaya (JP); Takashi Nishimura, Fukaya (JP)

(73) Assignees: Canon Kabushiki Kaisha, Tokyo (JP); Kabushiki Kaisha Toshiba, Tokyo (JP)

( * ) Notice: Subject to any disclaimer, the term of this patent is extended or adjusted under 35 U.S.C. 154(b) by 300 days.

(21) Appl. No.: 11/205,050

(22) Filed: Aug. 17, 2005

(65) Prior Publication Data

US 2006/0055637 A1 Mar. 16, 2006

(30) Foreign Application Priority Data

Aug. 27, 2004 (JP) ..... 2004-248546

(51) Int. Cl.
*H01J 7/24* (2006.01)
*G09G 3/22* (2006.01)

(52) U.S. Cl. ..... 315/111.91; 313/495; 313/496; 313/545; 313/546; 417/48; 417/49; 417/50; 417/51

(58) Field of Classification Search ..... 313/7, 313/495, 493, 545–566; 345/75.2; 315/111.91, 315/111.81
See application file for complete search history.

(56) References Cited

U.S. PATENT DOCUMENTS 5,591,061 A * 1/1997 Ikeda et al. ..... 445/3
5,831,387 A * 11/1998 Kaneko et al. ..... 313/495
5,936,342 A 8/1999 Ono et al. ..... 313/495
6,049,165 A * 4/2000 Spindt et al. ..... 313/495
6,232,599 B1 * 5/2001 Littlejohn ..... 250/288
6,259,191 B1 * 7/2001 Mitome et al. ..... 313/310
6,416,374 B1 * 7/2002 Mitome et al. ..... 445/6
6,522,054 B2 * 2/2003 Shibata ..... 313/310
6,538,391 B1 * 3/2003 Suzuki et al. ..... 315/169.3
6,582,268 B1 6/2003 Jindai et al. ..... 445/6
6,624,586 B2 * 9/2003 Abe et al. ..... 315/169.1
6,726,520 B2 4/2004 Takeda et al. ..... 445/62
6,827,621 B1 12/2004 Enomoto et al. ..... 445/24
6,846,213 B2 1/2005 Sato ..... 445/6
6,848,961 B2 2/2005 Nomura et al. ..... 445/24
7,091,662 B2 8/2006 Hasegawa et al. ..... 313/555
2002/0017849 A1 * 2/2002 Nukanobu et al. ..... 313/310

(Continued)

FOREIGN PATENT DOCUMENTS

JP 3-32354 2/1991

(Continued)

*Primary Examiner*—Lisa Caputo
*Assistant Examiner*—Tracie Y Green
(74) *Attorney, Agent, or Firm*—Fitzpatrick, Cella, Harper & Scinto

(57) ABSTRACT

Provided is an image display apparatus including: a vacuum container having an electron source enclosed therein for displaying an image; an ion pump communicating with the vacuum container for discharging air therefrom and decreasing pressure therein; and a resistor connected in series with the ion pump with respect to a power supply for driving the ion pump. Even if internal resistance of the ion pump undergoes order-of-magnitude changes according to its operating state, current consumption can be suppressed and the ion pump can be driven efficiently.

16 Claims, 11 Drawing Sheets

U.S. PATENT DOCUMENTS

| | | | | |
|---|---|---|---|---|
| 2002/0158571 | A1* | 10/2002 | Ando | 313/496 |
| 2002/0180342 | A1 | 12/2002 | Yamada et al. | 313/493 |
| 2003/0104751 | A1* | 6/2003 | Jindai et al. | 445/6 |
| 2005/0009433 | A1 | 1/2005 | Nomura et al. | 445/24 |
| 2006/0043865 | A1 | 3/2006 | Gofuku et al. | 313/362.1 |
| 2006/0043866 | A1 | 3/2006 | Tsuda et al. | 313/365 |
| 2006/0043870 | A1 | 3/2006 | Tsuda et al. | 313/495 |
| 2006/0043871 | A1 | 3/2006 | Kamio et al. | 313/495 |
| 2006/0049734 | A1 | 3/2006 | Sato et al. | 313/153 |

FOREIGN PATENT DOCUMENTS

| | | |
|---|---|---|
| JP | 5-121012 | 5/1993 |
| JP | 9-82245 | 3/1997 |
| JP | 2000-133136 | 5/2000 |
| JP | 2000-311599 | 11/2000 |
| JP | 2000-315458 | 11/2000 |
| JP | 2001-210258 | 8/2001 |

* cited by examiner

IMAGE DISPLAY APPARATUS

BACKGROUND OF THE INVENTION

1. Field of the Invention

The present invention relates to an image display apparatus using electron emitting elements.

2. Related Background Art

In a flat panel display where a large number of electron emitting elements as an electron source are arranged on a flat substrate, and a phosphor as an image forming member on an opposing substrate is irradiated with electron beams emitted from the electron source, thereby making the phosphor body emit light to display an image, it is necessary to maintain under high vacuum the inside of a vacuum container having therein the electron source and the image forming member. The reason is that, if gas is produced and the pressure is increased within the vacuum container, the electron source is adversely affected depending on the kind of the gas to decrease the amount of emitted electrons and a bright image can not be displayed.

In particular, it is a characteristic problem in a flat panel display that gas produced from the image display member accumulates around the electron source before the gas reaches a getter provided outside an image display area, leading to local pressure increase and associated deterioration of the electron source. Japanese Patent Application Laid-open No. H09-082245 describes a getter provided in an image display area for instantaneously absorbing produced gas to suppress deterioration and breakage of the elements. Japanese Patent Application Laid-open No. 2000-133136 describes a structure where a non-evaporable getter is provided in an image display area while an evaporable getter is provided outside the image display area. Further, as described in Japanese Patent Application Laid-open No. 2000-315458, a method is also devised where degasing, forming of a getter, and seal bonding (to form a vacuum container) are conducted in a series of operations.

Getters can be broken down into evaporable getters and non-evaporable getters. An evaporable getter can absorb water and oxygen at an extremely high speed while both an evaporable getter and a non-evaporable getter can absorb almost no inert gas such as argon (Ar). Argon gas is ionized into plus ions by electron beams. The plus ions are accelerated by an electric field for accelerating electrons and are bombarded onto the electron source, thereby damaging the electron source. Further, in some cases, electric discharge is caused inside, which can break the apparatus.

On the other hand, Japanese Patent Application Laid-open No. H05-121012 describes a method for maintaining high vacuum for a long time by connecting a sputter ion pump to a vacuum container of a flat panel display. However, a method of driving an ion pump suitable for use in an image display apparatus and a structure of the same are not described therein.

SUMMARY OF THE INVENTION

An object of the present invention is to provide an image display apparatus which, when an ion pump is used in the image display apparatus, has less adverse effect on a power supply and a peripheral circuit, maintains stable brightness for a long time, and has more even brightness in an image forming area by driving the ion pump in an efficient way.

This invention is directed to an image display apparatus including at least: a vacuum container including an electron source and an anode electrode opposing the electron source, the vacuum container being kept under a reduced pressure; an anode power supply for applying voltage to the anode electrode; an ion pump provided to communicate with the vacuum container; and a first resistor connected in series with the ion pump with respect to a power supply for driving the ion pump.

This invention is also directed to an image display apparatus including at least: a vacuum container including an electron source and an anode electrode opposing the electron source, the vacuum container being kept under a reduced pressure; an anode power supply for applying voltage to the anode electrode; an ion pump provided to communicate with the vacuum container; a first resistor connected in series with the ion pump with respect to a power supply for driving the ion pump; and a second resistor connected in parallel with the ion pump with respect to the power supply for driving the ion pump.

DETAILED DESCRIPTION OF THE PREFERRED EMBODIMENTS

This invention is directed to an image display apparatus including at least: a vacuum container including an electron source and an anode electrode opposing the electron source, the vacuum container being kept under a reduced pressure; an anode power supply for applying voltage to the anode electrode; an ion pump provided to communicate with the vacuum container; and a first resistor connected in series with the ion pump with respect to a power supply for driving the ion pump.

Another aspect of this invention is directed to an image display apparatus including at least: a vacuum container including an electron source and an anode electrode opposing the electron source, the vacuum container being kept under a reduced pressure; an anode power supply for applying voltage to the anode electrode; an ion pump provided to communicate with the vacuum container; a first resistor connected in series with the ion pump with respect to a power supply for driving the ion pump; and a second resistor connected in parallel with the ion pump with respect to the power supply for driving the ion pump.

In the present invention, it is preferable to use the anode power supply as the power supply for driving the ion pump.

Further, in the present invention, as the first resistor (including an aspect where the second resistor is used at the same time) and the second resistor, a thin film formed inside the vacuum container can be used.

According to the present invention, an image display apparatus which, when an ion pump is used in the image display apparatus, has less adverse effect on a power supply and a peripheral circuit, maintains stable brightness for a long time, and has more even brightness in an image forming area by driving the ion pump in an efficient way can be provided.

A structure having an electron source substrate which has electron emitting elements arranged thereon (hereinafter referred to as a rear plate) and an image forming substrate which is provided correspondingly to the electron source substrate and has a phosphor film and an anode electrode film as the anode electrode (hereinafter referred to as a face plate) is now described as the image display apparatus.

(Brief Description of Image Display Apparatus to which the Invention is Applied)

Figure 1:
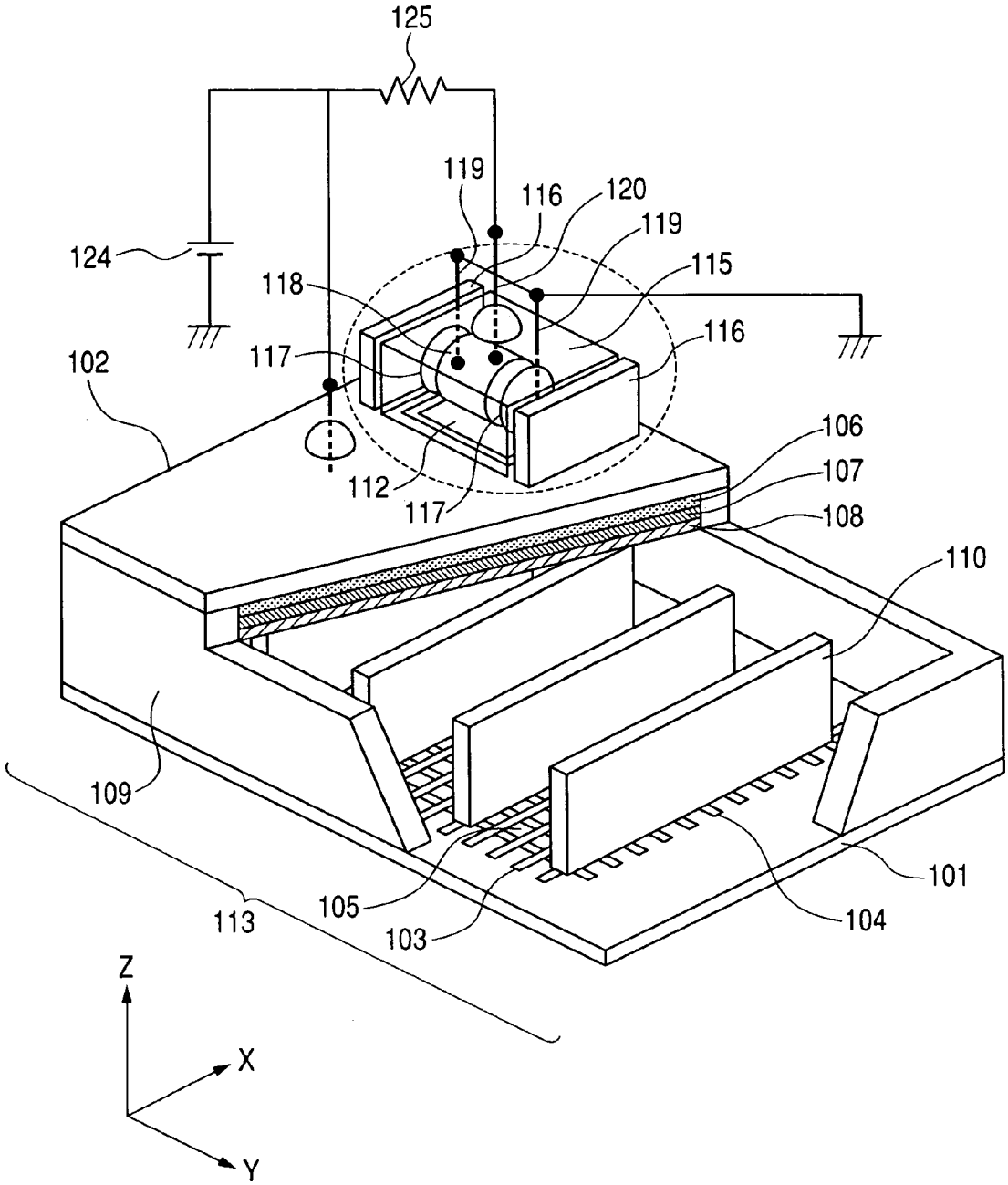
FIG. 1 is a schematic perspective view of an image display apparatus according to an embodiment of the present invention.
Figure 2:
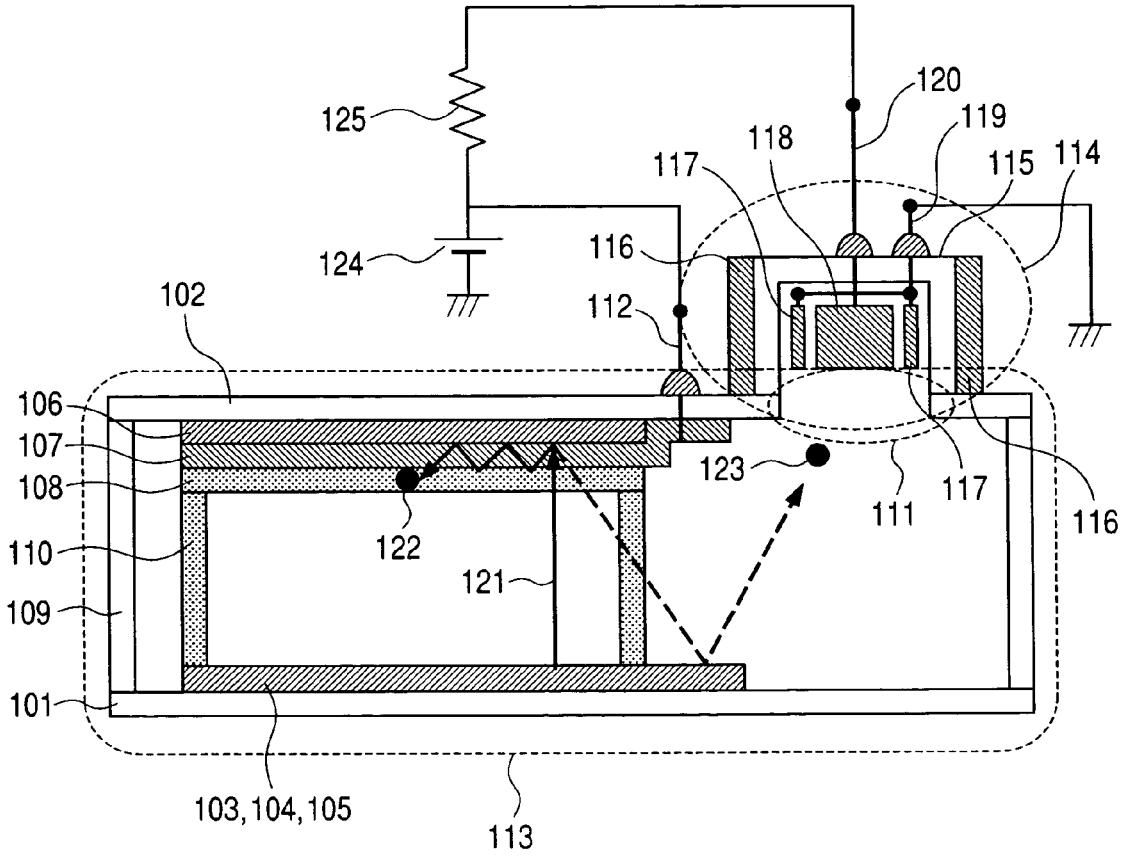
FIG. 2 is a schematic sectional view of the image display apparatus according to the embodiment of the present invention.

FIGS. 1 and 2 schematically illustrate an embodiment of a structure of an image display apparatus to which the present invention is applicable. A phosphor body 106 and a metal back 107 as an anode electrode film are formed on a face plate 102. A terminal portion 112 is drawn out of a vacuum container to apply high voltage to the metal back 107. A plurality of electron emitting elements are arranged on the rear plate 101, and an electron source 105 with appropriate wiring 103 and 104 is formed. Further, an evaporable getter 108 is formed on the metal back. The face plate 102 and the rear plate 101 together with a frame member 109 form a vacuum container. In order to support the vacuum container against atmospheric pressure, supporting members (spacers) 110 are provided between the rear plate and the face plate.

Figure 3A:
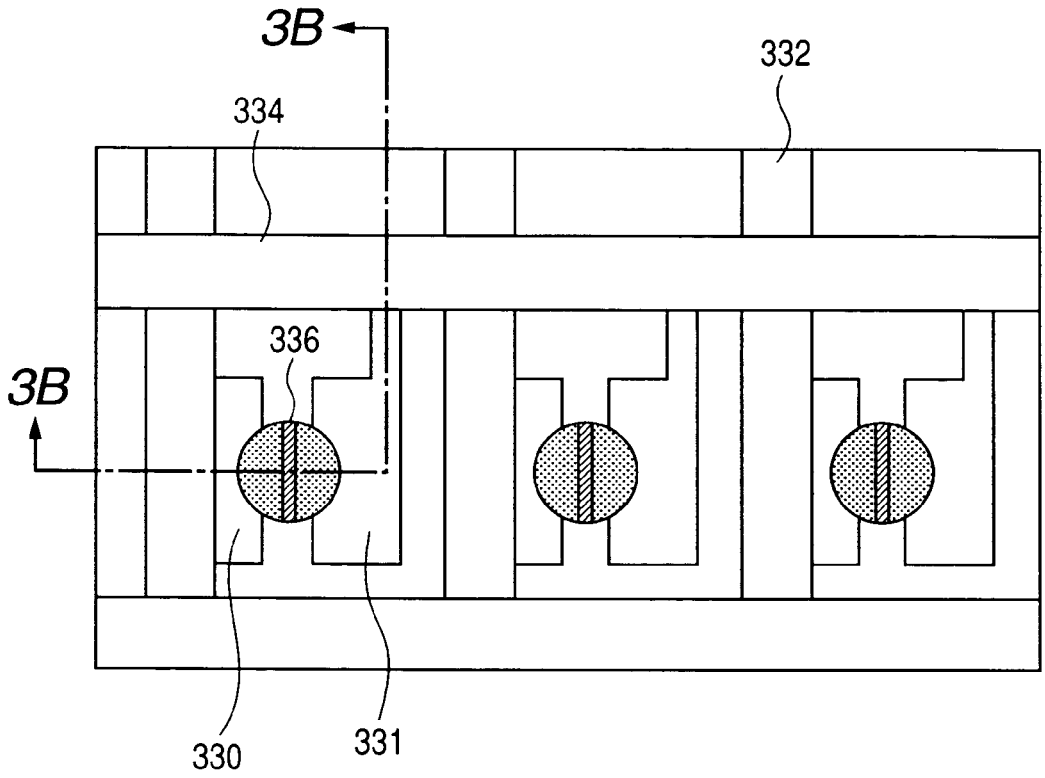
FIGS. 3A and 3B are schematic views of an exemplary passive matrix arrangement of a surface conduction type electron emitting elements.
Figure 3B:
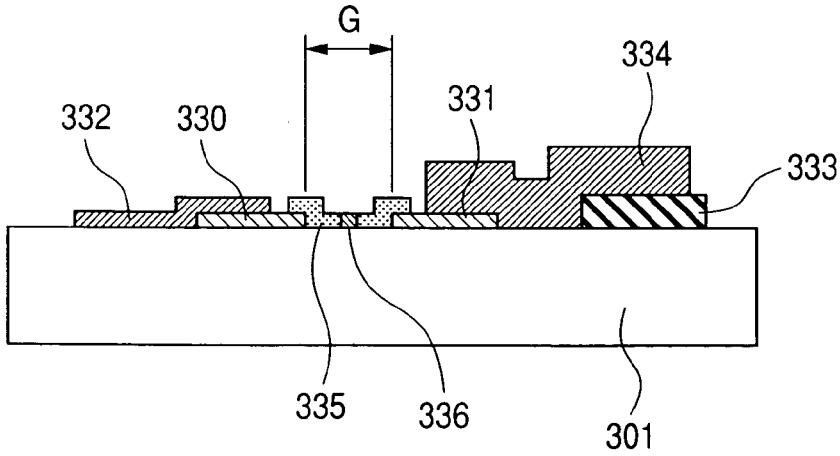

FIGS. 3A and 3B schematically illustrate a structure where the two-dimensionally arranged electron emitting elements are connected via matrix wiring. Although a flat conduction type electron emitting elements are illustrated as exemplary electron emitting elements, FEDs represented by Spindt type ones or flat type field effect type electron emitting elements can be also used to attain similar effects. The following description is as to the exemplary flat conduction type electron emitting elements. FIG. 3A is a plan view while FIG. 3B is a sectional view taken along the line 3B-3B.

Y wiring (upper wiring) 334 and X wiring (lower wiring) 332 are connected to an electron emitting element 336 via element electrodes 330 and 331, respectively. The X wiring 332 is disposed on an insulating substrate 301, and an insulating layer 333, the Y wiring 334, and the electron emitting element 336 are formed thereon in this order. As the materials of opposing element electrodes 330 and 331, common conductive materials can be used.

As a conductive thin film 335, in order to obtain satisfactory electron emission characteristics, it is preferable to use a fine-grained film made of grains. The thickness of the film is appropriately set taking into consideration step coverage over the element electrodes 330 and 331, resistance between the element electrodes, forming conditions to be described below, and the like. Typically, it is preferable that the film thickness ranges from several tenths of a nanometer to several hundred nanometers, and more preferably, from 1 nm to 50 nm. Its sheet resistance Rs is 100 to 10M Ω/□. It is to be noted that the sheet resistance Rs is a value determined by $R=Rs(l/w)$ wherein R, t, w, and l are the resistance, the thickness, the width, and the length of the thin film, respectively. Although a forming processing is herein described with reference to energization processing by way of example, the forming processing is not limited thereto and includes processing where a crack is generated in the thin film to create a high resistance condition.

The electron emitting element 336 is formed of a highly resistant crack formed in a portion of the conductive thin film 335. The electron emitting element 336 depends on the thickness, the quality, and the material of the conductive thin film 335, the methodology of energization forming to be described below, and the like. In some cases, conductive grains exist inside the electron emitting element 336 the size of the grains ranging from several tenths of a nanometer to several tens of nanometers. The conductive grains contain a part or all of the elements of the material forming the conductive thin film 335. Further, processing such as electrically activating processing may be conducted such that the electron emitting element 336 and the conductive thin film 335 adjacent thereto contain carbon and carbon compound to enhance the electron emitting effects.

The face plate 102, the rear plate 101, the electron source 105, and other structures formed as described above are assembled, and the face plate 102 and the rear plate 101 are joined together with the supporting frame 109 sandwiched therebetween. For example, the face plate 102 and the supporting frame 109 are fixed together in advance with frit glass, and degasing and forming an evaporable getter are conducted in a vacuum chamber, followed by seal bonding without breaking the vacuum (a vacuum container is formed). As described in Japanese Patent Application Laid-open No. 2000-315458, the rear plate and the face plate with the supporting frame are joined together using In or an alloy thereof.

The image display apparatus according to the present invention may be used as a display for television, for a display for a videoconference system, for a display for a computer, and the like, as well as an image forming apparatus as an optical printer formed using a photosensitive drum and the like.

(Description of Structure of Ion Pump and Connected Resistance)

According to the present invention, in order to maintain the vacuum, an ion pump 114 communicates with the image display apparatus through an opening 111 for the ion pump provided in the face plate or the rear plate. The ion pump 114 includes an ion pump housing 115, magnets 116, ion pump cathodes 117, an ion pump anode 118, a cathode terminal 119, and an anode terminal 120. High voltage is applied to the anode 107 from an anode power supply 124 via a high voltage terminal 112. FIG. 1 illustrates a first aspect and high voltage is applied to the ion pump anode terminal 120 from the anode power supply 124 via a first resistor 125.

FIGS. 1 and 2 are now used to describe the concept of the action of a getter provided in the image display area and of the ion pump provided outside the image display area. When an image display apparatus 113 is driven and emitted electrons 121 are irradiated onto the face plate members 106 and 107 (the phosphor body, the metal back, and the like), gas is produced. Most oxide gases 122, for example, water, oxygen, carbon monoxide, and carbon dioxide are absorbed by the getter 108. Other gases liable to damage the electron emitting elements include inert gases (in particular, argon) 123. Inert gases are more difficult to absorb using a getter than oxide gases, but since its emission rate is small, by absorbing them with the ion pump 114 outside the image display area, the pressure increase can be suppressed. As a result, since considerable pressure increase due to gases such as argon is suppressed while the oxide gases 122, which are the main cause of the deterioration of the elements, are efficiently reduced, instability of the characteristics of the elements can be suppresses.

Here, operation of the ion pump attached to the image display apparatus is briefly described. First, when the ion pump reaches normal operation, the ion pump exhausts the gases at a fixed rate, and electric current (referred to as ion pump current) in proportion to the pressure flows. On the other hand, the inside of the image display apparatus to which the ion pump is attached is in a high static pressure condition immediately after the manufacture. Therefore, when the ion pump is driven to start normal operation, a large amount of ion pump current flows at the beginning, and then, the amount decreases exponentially with a time constant which is determined by the internal volume of the image display apparatus and the exhaust rate of the ion pump. "When the ion pump reaches normal operation" as used herein means "at the first time when the ion pump reaches normal operation after it is actuated."

Next, a method of driving the ion pump which characterizes the present invention is described. The ion pump starts its operation at about 1 kV, and its exhausting capacity increases as the applied voltage becomes higher. However, higher applied voltage has adverse effects such as higher power consumption and the necessity of reliable insulation. Therefore, voltage in the range from 3 to 5 kV is used for efficiently driving the ion pump (hereinafter the voltage for driving the ion pump is denoted as Vip). It is to be noted that, since the ion pump may be actuated only when the applied voltage is higher than that when the ion pump reaches normal operation due to oxidation of the surfaces of the electrodes used at the anode and the cathodes in the ion pump and the like, it is actually preferable to prepare a power supply which can apply voltage higher than 3 to 5 kV.

When the ion pump mainly takes in a large amount of argon, argon ions and atoms implanted into the cathodes (formed of Ti or the like) in the ion pump are reemitted to make the ion pump deviate from normal operation. The ions and atoms reemitted from the cathodes are taken in by a Ti film sputtered on the anode or the like, where the ion pump current becomes one or two orders of magnitude larger than that when the ion pump reaches normal operation. In this case, it is desirable that Vip is lowered.

In this way, even the applied voltage is the same, electric current between the anode and the cathodes of the ion pump varies depending on the surface state of the electrodes and the atmosphere, and thus, the portion between the anode and the cathodes of the ion pump can be equivalently regarded as a variable resistor when viewed as a part of an electric circuit. This is denoted as equivalent ion pump resistance Rip. When the equivalent ion pump resistance when the ion pump reaches normal operation, the equivalent ion pump resistance when the ion pump is actuated, and the equivalent ion pump resistance when argon is reemitted are denoted as Ripm, Riph, and Ripl, respectively, the relationship of the three is expressed as:

$$Ripl \ll Ripm \ll Riph,$$

which means that the equivalent ion pump resistance Rip undergoes order-of-magnitude changes.

According to the first aspect of the present invention, the first resistor is connected to the anode power supply in series with the ion pump. More specifically, by applying voltage from the anode power supply to the ion pump via the first resistor, even if the ion pump resistance undergoes order-of-magnitude changes according to its state, the current consumption can be suppressed and the ion pump can be driven efficiently.

The voltage Vip applied to the ion pump is the anode voltage (Va) divided by the equivalent ion pump resistance and the first resistor:

$$Vip = Va \times Rip/(Rip + R1),$$

wherein R1 is the resistance of the first resistor. Here, if the resistance R1 is similar to the equivalent ion pump resistance when the ion pump reaches normal operation Ripm (R1≈Ripm), since Ripl<<R1<<Riph, the following relationships hold in the respective states.

(i) When the Ion Pump Reaches Normal Operation

Voltage applied when the ion pump reaches normal operation (Vipm) is expressed as follows:

$$Vipm = Va \times Ripm/(Ripm + R1).$$

(ii) When the Ion Pump is Actuated

Voltage applied when the ion pump is actuated (Viph) is expressed as follows:

$$Viph = Va \times Riph/(Riph + R1) \approx Va.$$

(iii) When Argon is Reemitted

Voltage applied when argon is reemitted (Vipl) is expressed as follows:

$$Vipl = Va \times Ripl/(Ripl + R1) \approx 0.$$

For example, when Va=10 kV and the equivalent ion pump resistance when the ion pump reaches normal operation Ripm=1000 MΩ, if a 1000 MΩ resistor is connected in series between the anode power supply and the ion pump, appropriate voltage is applied to the ion pump in a self-controlling manner (e.g., Vipm≈5 kV, Viph≈10 kV, and Vipl≈0 kV). As a result, a large amount of current flows only when necessary (i.e., when the ion pump is actuated), and thus, power consumption can be saved. Further, a small image display apparatus at a lower price can be materialized.

Though the above description is based on that the resistance R1 of the first resistor is similar to the equivalent ion pump resistance when the ion pump reaches normal operation Ripm, even if R1 is smaller, by inserting the resistor in series, the power consumption when argon is reemitted can be suppressed accordingly. However, this is substantially effective when R1 is 0.05 times as much as Ripm or larger, preferably 0.1 times as much as Ripm or larger, and more preferably 0.5 times as much as Ripm or larger. On the other hand, if R1 is too large compared with Ripm, voltage applied to the ion pump when the ion pump reaches normal operation is lowered, and as a result, a high power supply voltage must be prepared, which means, in some cases, the anode power supply of the image display apparatus can not be used. Therefore, R1 is 20 times as much as Ripm or smaller, preferably 10 times as much as Ripm or smaller, and more preferably 3 times as much as Ripm or smaller. Most preferably, R1 ranges from one time as much as Ripm to twice as much as Ripm.

Here, the resistance Ripm is a value specific to the structure of the ion pump, and can be determined from electric current when the ion pump operates with constant current which appears a little after the ion pump is actuated. Ripm of the ion pump which can be used in the image display apparatus according to the present invention is, for example, 10 MΩ to 10000 MΩ, and more specifically, 100 MΩ to 1000 MΩ.

In a second aspect of the present invention, in addition to a first resistor R1 connected in series between an anode power supply and an ion pump, a second resistor R2 is connected between R1 and GND in parallel with the ion pump. In the above-described aspect where only the first resistor R1 is provided, particularly when the ion pump is actuated, a large voltage difference occurs between the ion pump anode terminal and the ion pump cathode terminal (grounded). In this aspect, insulation at ion pump terminal portions is deemed important, and voltage applied to the ion pump is fixed as much as possible except when argon is reemitted. In order to make similar the voltage applied to the ion pump when the ion pump is actuated to that when the ion pump reaches normal operation, a resistor the resistance of which is an order of magnitude smaller than the equivalent ion pump resistance Ripm when the ion pump reaches normal operation is connected in parallel. Voltages between the ion pump terminals when the ion pump is actuated and when the ion pump reaches normal operation are approximately the anode voltage divided by R1 and R2. When Ripm is 1000 MΩ, R1≈R2≈several hundreds MΩ are connected. In this case, power which is a little lower than 1 W is always consumed, but since voltage Vip applied to the terminal portions introducing voltage to the ion pump is always kept lower than the anode voltage, measures necessary for insulating the ion pump portion are eased. Further, since current when argon is reemitted is also suppressed in this case, power consumption is expected to be saved to some extent.

In the second aspect of the present invention, though, in the above description, R1=R2=Ripm/10, since current consumption becomes larger if R2 is too small compared with Ripm, R2 is 0.01 times as much as Ripm or larger, preferably 0.05 times as much as Ripm or larger, and more preferably 0.07 times as much as Ripm or larger. Further, since, if R2 is too large, it does not contribute to insulation between the terminals of the ion pump, R2 is one time as much as Ripm or smaller, preferably 0.5 times as much as Ripm or smaller, and more preferably 0.2 times as much as Ripm or smaller. R1 is 0.5 to 10 times as much as R2, preferably 0.7 to 5 times as much as R2, and more preferably 1 to 3 times as much as R2.

Further, in the first and the second aspects, although, as described above, it is most convenient and preferable to use the anode power supply of the image display apparatus also as the power supply of the ion pump, when necessary, a power supply solely for the ion pump may be used.

Further, the ion pump may be attached to the side of the rear plate. In addition, the first resistor in the first aspect and the first and second resistors in the second aspect may be an external resistor/external resistors as an electric part/electric parts, but a member used inside the vacuum container, in particular, an anti-static film or the like, may also be utilized. In this case, since it is not necessary to attach an additional part to the external of the image display apparatus, the image display apparatus can be miniaturized.

By the above-described structure, according to the present invention, an image display apparatus which has less adverse effect on a power supply and a peripheral circuit, maintains stable brightness for a long time, and has more even brightness in an image forming area by driving the ion pump in an efficient way can be provided.

EMBODIMENTS

Although the present invention is now described in further detail with reference to preferable embodiments, the present invention is not limited thereto and includes various substitutions and design changes which fall within the scope and spirit of the present invention.

Embodiment 1

An image display apparatus of this embodiment has a structure similar to that illustrated in the schematic views of FIGS. 1 and 2. The image display apparatus of this embodiment includes an electron source 105 where a plurality (768 rows×3840 columns) of surface conduction type electron emitting elements form a passive matrix on a substrate. As illustrated in FIG. 1, an ion pump 114 is attached to a face plate outside the image display area, and communicates with the inside of a vacuum container through an opening 111 for the ion pump provided in advance in the face plate. In the ion pump, a cylindrical anode 118 and cathodes 117 provided near plane portions on both sides of the cylinder are placed in a glass case (housing) 115, and magnet plates 116 are in intimate contact with the outside of the glass case so as to be in parallel with the cathodes. The anode and the cathodes are connected to terminals 120 and 119, respectively, which are embedded through the glass case.

FIG. 1 illustrates a first embodiment of the present invention. The anode terminal 120 is connected to an anode power supply 124 of the panel via an external first resistor 125, while the cathode terminal 119 is grounded.

With regard to a face plate 102, a Ba film 108 is deposited on a metal back 107 by flash film forming. Spacers 110 are provided on every 40 upper wirings (5, 45, 85, . . . 765).

FIGS. 3A and 3B schematically illustrate the matrix in FIG. 1, the element electrodes, and a state where the elements are connected. FIG. 3A is a plan view and FIG. 3B is a sectional view taken along the line 3B-3B in FIG. 3A. Here, reference numeral 301 denotes an electron source substrate of a glass substrate, reference numeral 324 denotes Y wiring or upper wiring, reference numeral 332 denotes X wiring or lower wiring, reference numeral 335 denotes a conductive film including an electron emitting portion, reference numerals 330 and 331 denote element electrodes, and reference numeral 333 denotes an interlayer insulating layer.

A method of manufacturing the image display apparatus according to this embodiment is now described with reference to FIGS. 2, 3A and 3B.

(Process-a1 (Glass Substrate, Element Electrode Formation))

A PD-200 (manufactured by Asahi Glass Co., Ltd.) glass substrate 301 at the thickness of 2.8 mm was sufficiently cleaned using a detergent, pure water, and an organic solvent. An $SiO_2$ film at the thickness of 0.1 μm was formed on the glass substrate 301 by sputtering. Next, on the $SiO_2$ film formed on the glass substrate 301, a titanium (Ti) film was formed at the thickness of 5 nm as an under coat layer, and then a platinum (Pt) film was formed at the thickness of 40 nm, both by sputtering. After that, a photoresist (AZ1370 manufactured by Hoechst) was applied, and patterned by a series of photolithographic techniques, i.e., exposure, development, and etching, to form the element electrodes 330 and 331. The space between the element electrodes was 10 μm, and their opposing lengths were 100 μm.

(Process-b1 (Lower Wiring Formation))

The material of the X wiring and Y wiring is desired to be low resistant such that substantially even voltage is supplied to the plurality of surface conduction type elements, and the material, film thickness, wiring pitch, and the like are appropriately set. The X wiring (lower wiring) 332 as common wiring was formed in a linear pattern such that it is in contact with the element electrodes 330 and connects them. Silver (Ag) photo paste ink was used as the material. After it was screen printed, it was dried and exposed to light to be developed in a predetermined pattern. After that, it was baked at about 480° C. to form the wiring. The wiring had the thickness of about 10 μm and the width of 50 μm. It is to be noted that end portions had larger width since they are used as wiring take out electrodes.

(Process-c1 (Insulating Film Formation))

In order to insulate the upper and lower wirings from each other, the interlayer insulating layer is formed. The interlayer insulating layer was formed below the Y wiring (upper wiring) 334 to be described in the following such that it covers intersections of the Y wiring 334 and the X wiring (lower wiring) 332 which was already formed, and such that electrical connection is allowed between the upper wiring (Y wiring) 334 and the other element electrode 331 with a contact hole formed at the connecting portion. After photosensitive glass paste which is predominantly composed of PbO was screen printed, it was exposed to light to be developed.

This was repeated four times, and at last, baking was carried out at about 480° C. The interlayer insulating layer had the thickness of about 30 μm (the total of the four layers) and the width of 150 μm.

(Process-d1 (Upper Wiring Formation))

AgO paste ink was screen printed on the previously formed insulating film, and then it was dried. A similar process was repeated once more to apply the Y wiring 334 twice. Then, baking was carried out at about 480° C. to form the Y wiring (upper wiring) 334. The Y wiring (upper wiring) 334 intersects the X wiring (lower wiring) 332 with the insulating film positioned therebetween, and is also connected to the other element electrode 331 at the contact hole portion of the insulating film. The other element electrode 331 is connected through this wiring, and acts as a scanning electrode after a panel is completed. The Y wiring 334 has the thickness of about 15 μm. Although not shown in the figure, a drawn terminal to an external driving circuit was formed in a similar way. In this way, a substrate having XY matrix wiring was formed.

(Process-e1 (Element Film Formation))

After the above-described substrate was sufficiently cleaned, the surface thereof was treated with solvent containing water repellent such that the surface became hydrophobic. The water repellent used was solvent of DDS (Dimethyldiethoxysilane, manufactured by Shin-Etsu Chemical Co., Ltd.) diluted by ethyl alcohol. The water repellent was sprayed on the substrate, and dried by hot air at 120° C. After that, an element film 335 was formed between the element electrodes by ink jet application. In this embodiment, since a palladium film was formed as the element film, 0.15 wt % of palladium-proline complex was first dissolved in an aqueous solution made of 85 parts of water and 15 parts of isopropyl alcohol (IPA) to obtain a solution containing organic palladium. A small amount of additive was further added. As means for giving drops, an ink jet ejector utilizing a piezoelectric element was used. After that, the substrate was heated to be baked in air at 350° C. for 10 minutes to obtain palladium oxide (PdO). The formed PdO film had the dot diameter of about 60 μm and the maximum thickness of 10 nm.

(Process-f1 (Reduction Forming (Hood Forming)))

Figure 4A:
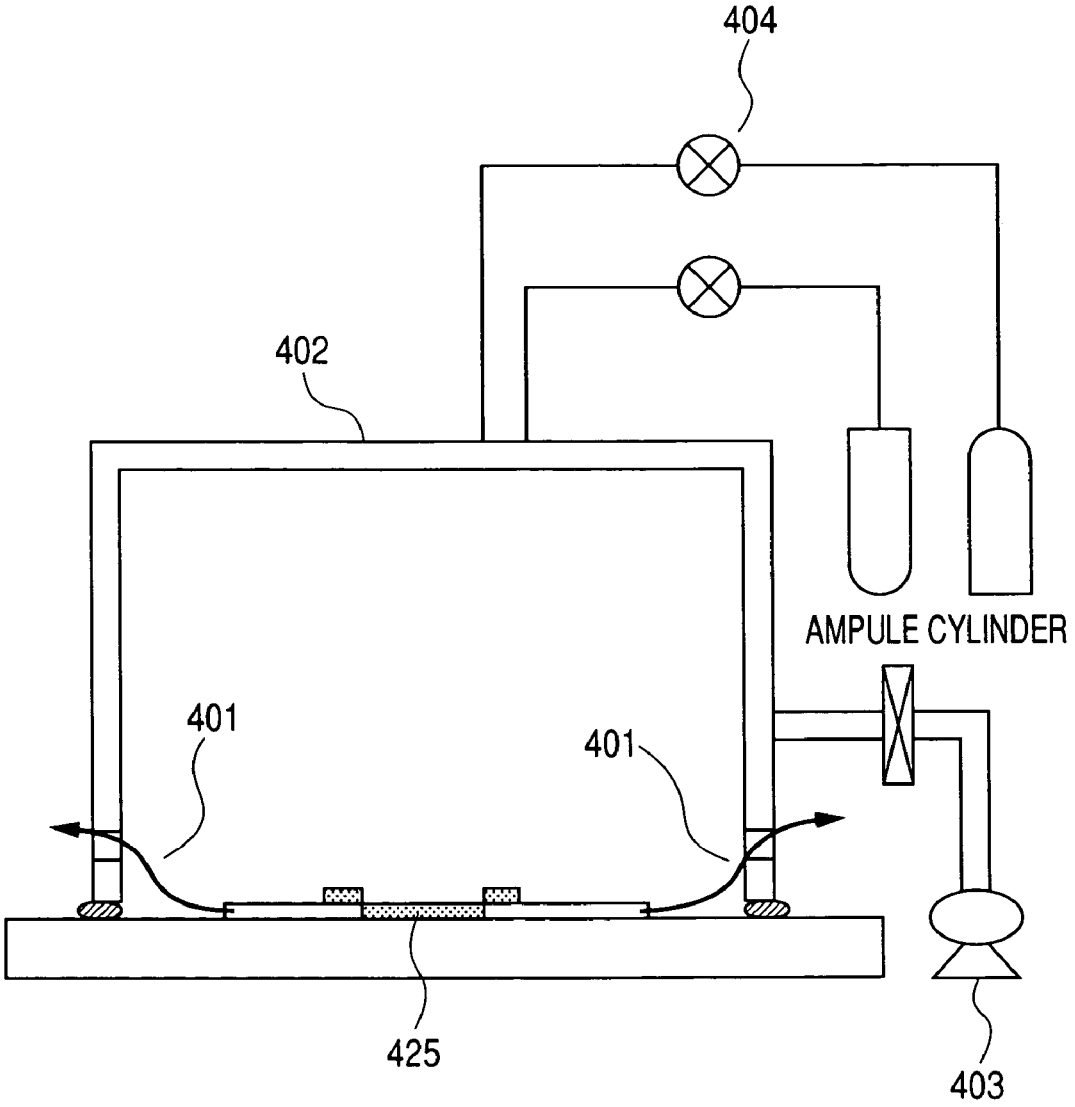
FIGS. 4A and 4B are explanatory views of forming and activating processes.
Figure 4B:
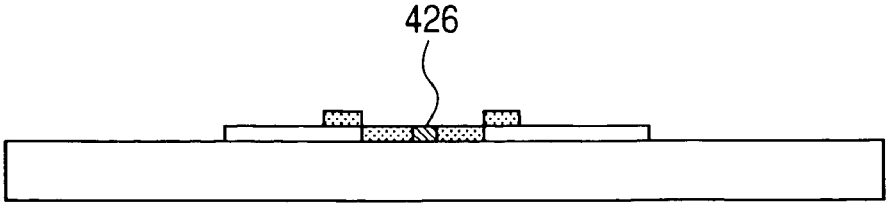

A process-referred to as forming is conducted to energize the above-described conductive thin film to generate a crack therein to form the electron emitting portion of the surface conduction type electron emitting element. Equipment and a method for the forming process are now briefly described with reference to FIGS. 4A and 4B. First, a hood-like lid 402 was put so as to cover the whole substrate except the take out electrodes around the substrate, and a vacuum was made between the substrate and the lid 402 utilizing discharging means 403. Then, voltage was applied between the X and Y wirings from electrode terminals 401 connected to an external power supply. By making current flow between the element electrodes, a conductive thin film 425 was locally broken, deformed, or altered to form an electrically high resistant electron emitting portion 426. Conditions of the forming such as applied voltage are described in detail in Japanese Patent Application Laid-open No. 200-311599, and appropriate conditions were selected therefrom.

In the forming process, energization and heating in a vacuum atmosphere containing a small amount of hydrogen gas promotes reduction, and palladium oxide (PdO) changes into a palladium (Pd) film. Here, due to the reduction, the film shrinks and a crack is generated in a part thereof. Resistance Rs of the obtained conductive thin film 425 was from 100 to 10 MΩ.

To determine when the forming processing is to be ended, the resistance of the element is measured. In this case, the forming was ended when the resistance becomes 1000 times as much as that before the forming processing.

(Process-g1 (Activation-carbon Deposition))

Since the electron emitting efficiency is very low after the forming, in order to make higher the electron emitting efficiency, processing referred to as activation was carried out with regard to the above element. The processing is carried out by, similarly to the case of the above-described forming, putting a hood-like lid to create a vacuum space between the lid and the substrate, and repeatedly applying pulse voltage to the element electrodes from the external through the X and Y wirings. Then, gas containing carbon atoms are introduced, and carbon or a carbon compound derived therefrom is made to deposit around the crack as a carbon film 426.

In this process, tolunitrile was used as the carbon source, which was introduced into the vacuum space through a slow leak valve 404 to maintain $1.3\times10^{-4}$ Pa. The pressure of tolunitrile to be introduced is preferably from $1\times10^{-5}$ Pa to $1\times10^{-2}$ Pa, although it is somewhat affected by the shape of the vacuum system, members used in the vacuum system, and the like. In this process, also, conditions such as applied voltage are described in Japanese Patent Application Laid-open No. 2000-311599, and appropriate conditions can be selected therefrom.

Element current If was saturated when about 60 minutes passed. The energization was stopped and the slow leak valve was closed to end the activating processing. The electron source substrate was manufactured in the above processes.

(Process-h1 (Attachment of Supporting Frame))

Figure 5:
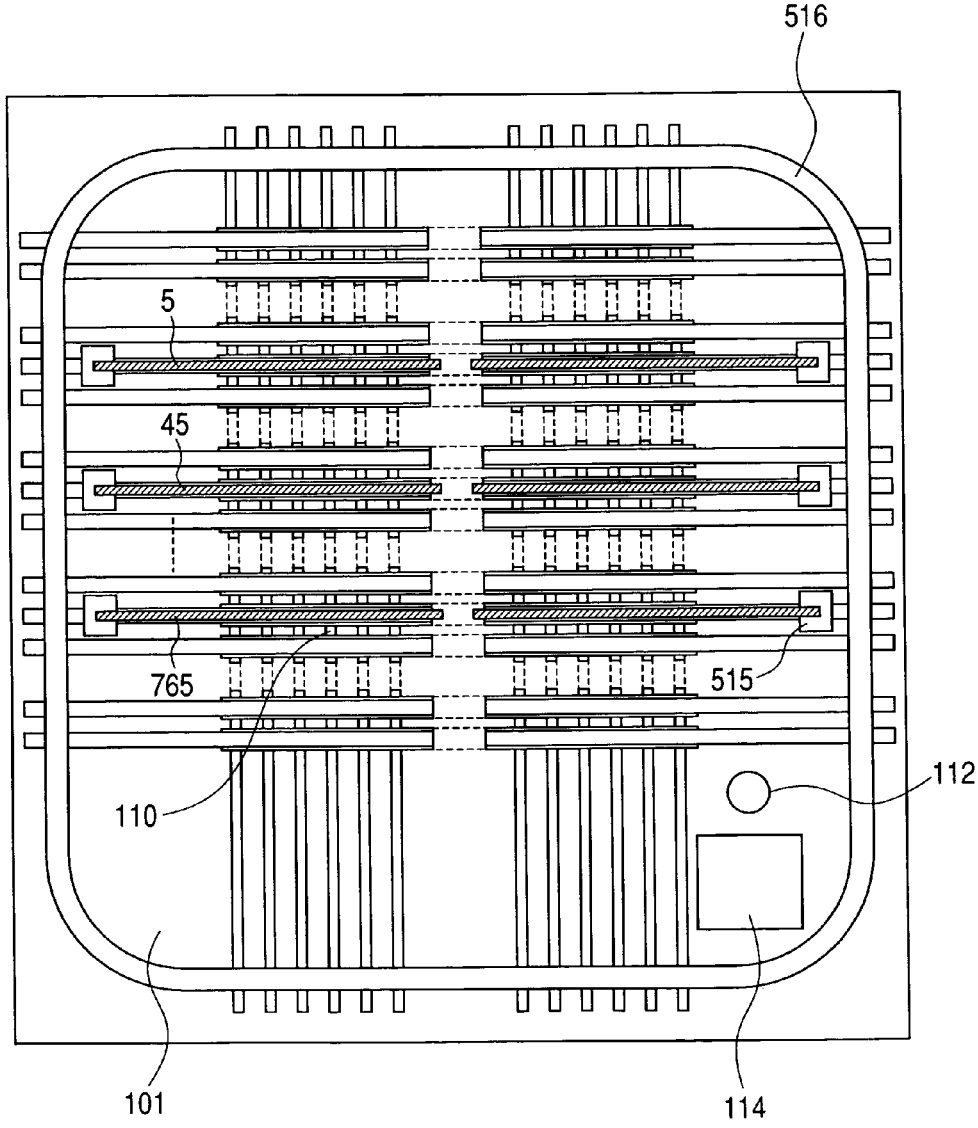
FIG. 5 is a schematic view of wiring and placement of spacers of the embodiment of an image display apparatus according to the present invention.

Next, as illustrated in FIG. 5, frit glass was applied to predetermined places on the rear plate, registration was performed, and a supporting frame 516 was temporarily attached to the face plate. After that, baking was carried out at 390° C. for 30 minutes to attach the supporting frame to the rear plate.

(Process-i1 (Spacer Placement))

As illustrated in FIG. 5, the spacers 110 were provided on a part of the lines (No. 5, 45, 85, 125, 165, 205, 245, 285, 325, 365, 405, 445, 485, 525, 565, 605, 645, 685, 725, and 765) of the Y wiring (upper wiring) of the electron source substrate 101. The spacers were fixed outside the area with elements (pixel area) using a ceramic adhesive (Aron Ceramic W manufactured by TOAGOSEI CO., LTD.) with an insulating stage (a thin plate glass) 515 used as a support.

(Process-j1 (Face Plate Formation))

First, a hole for anode connection terminal and the opening 111 for the ion pump were formed in a glass substrate (PD-200 (manufactured by Asahi Glass Company) at the thickness of 2.8 mm). The holes may be formed in advance by shaping the mold accordingly, or may be formed in a flat glass plate afterward. The holes are formed outside the image display area. Next, the anode connection terminal was embedded using conductive frit glass, baking was carried at 420° C. for an hour to harden the frit, and the anode connection terminal 112 was formed. An electrode of the anode connection terminal does not protrude into the inner surface of the vacuum container. The substrate was sufficiently cleaned using a detergent, pure water, and an organic solvent. Then, silver paste was applied to patterns of the anode connection terminal, an underlayer for filling In, and the like, and baking was carried out at about 480° C. Next, a phosphor film 106 was applied by printing, the surface was smoothed (usually referred to as "filming"), and the phosphor film was completed. It is to be noted that the phosphor film 106 was a phosphor film having stripe-like phosphors (R, G, and B) and black conducting material (black stripes) arranged alternately. Further, the metal back 107 made of an Al thin film was formed at the thickness of 50 nm by sputtering. The films 106 and 107 do not come in contact with the hole for the anode connection terminal 112 and the opening 111 for the ion pump, and a silver paste pattern which is not shown connects the metal back 107 and the anode connection terminal 112.

(Process-x1 (Attachment of Ion Pump))

First, the ion pump illustrated in FIG. 2 is assembled. When a glass case of the ion pump is manufactured, holes for anode and cathode terminals were formed at predetermined locations, where metal supports (not shown) for supporting the anode and the cathodes of the ion pump were embedded. Next, the anode and the cathodes of the ion pump were fixed by the metal supports, and electrodes were passed through the holes for the terminals to be connected to the anode and the cathodes. After that, the electrodes passing through the holes for the anode and the cathodes were temporarily fixed by frit glass, and at the same time, the assembled glass case 115 of the ion pump was temporarily fixed at the location of the opening 111 provided in the face plate. The face plate with the ion pump was baked at 420° C. for an hour to form the ion pump anode terminal 120 and the ion pump cathode terminal 119 and to fix the ion pump 114.

(Process-k1 (Application of In))

As described in Japanese Patent Application Laid-open No. 2001-210258, In was filled on the silver paste printed portion provided in advance at peripheral portions of the face plate.

(Process-l1 (Degasing, Getter Flash, and Seal-bonding))

Figure 6:
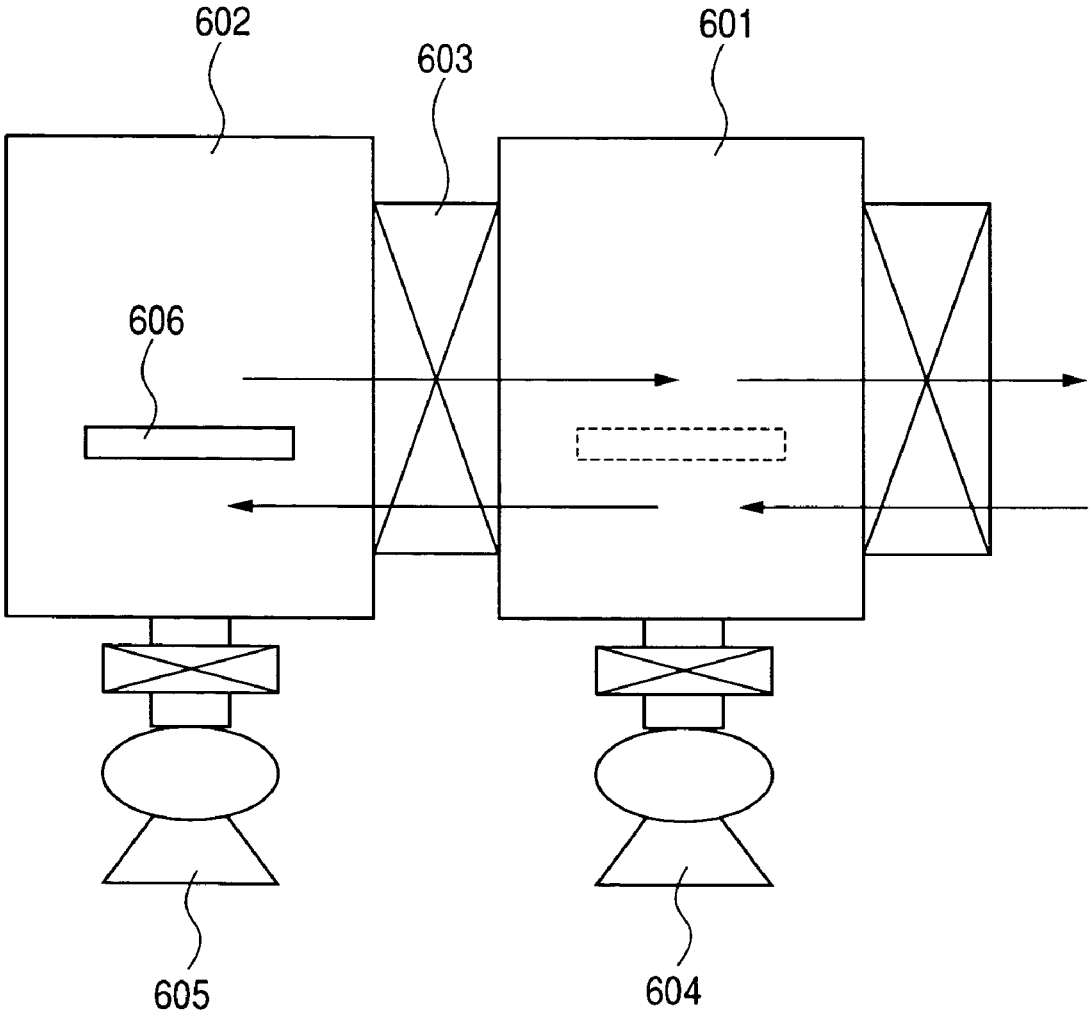
FIG. 6 is a schematic view of a vacuum pumping system for conducting baking, getter flash, and seal bonding during the image display apparatus is formed.

Next, the rear plate and the face plate formed in the above processes were set in the vacuum chamber illustrated in FIG. 6 to form the vacuum container. As shown in FIG. 6, the vacuum chamber is roughly broken down into a load chamber 601 and a vacuum processing chamber 602 for conducting baking, getter flash, seal bonding, and so on, and the two are connected with a gate valve 603 or the like. Although separate processing chambers may be provided for the respective processes, one processing chamber 602 conducts the series of processes in this embodiment. The load chamber and the processing chamber are provided with air pumps 604 and 605, respectively. The rear plate, the face plate, and a jig 606 having the two mounted thereon are introduced into the load chamber as shown by arrows, then sent to the processing chamber, and, after the processing ends, sent to the outside of the vacuum chamber through the load chamber.

Figure 7A:
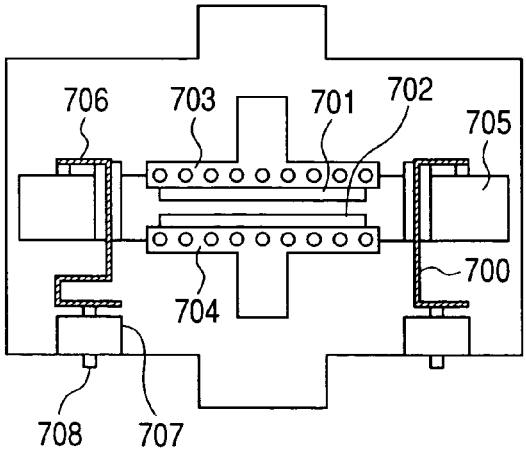
FIGS. 7A, 7B, 7C and 7D are explanatory views of baking, getter flash, and seal bonding processes during the image display apparatus is formed.
Figure 7B:
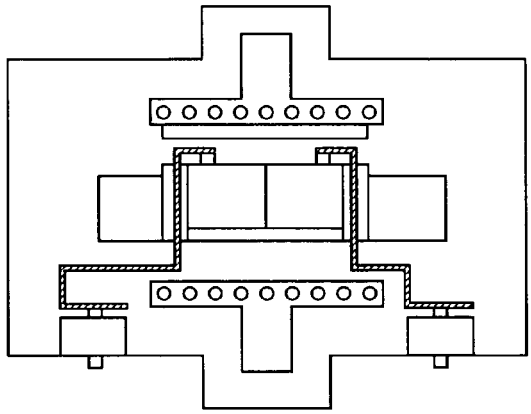
Figure 7C:
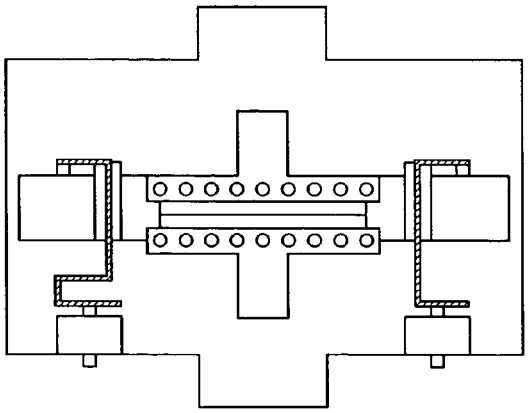
Figure 7D:
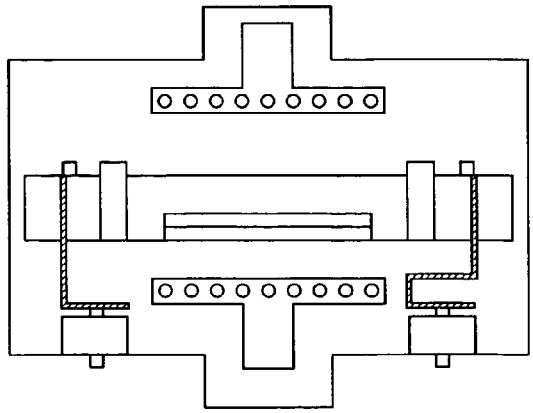

FIGS. 7A to 7D illustrate schematic views of the respective processes. FIG. 7A illustrates the baking process, FIG. 7B illustrates the getter flash process, FIG. 7C illustrates the seal bonding process, and FIG. 7D illustrates a state where preparation for sending out is completed. In the baking process, a rear plate 701 and a face plate 702 transferred by a transfer jig 700 are heated by hot plates 703 and 704. Further, a current lead-in 707 provided for a jig 705 (lid-like) for getter flash associated with the transfer jig 700 is connected to an electrode 708 drawn out to the external to flash the getter through overheating by energization. When seal bonding is carried out, the lid-like jig 705 moves to a side similarly to the case of the baking, a load is imposed on the substrate while the substrate is heated by the hot plates, and the rear plate and the face plate are adhered to each other with In. When the seal bonding is completed, the hot plates escape upward and downward, respectively, and the completed vacuum container is sent to the outside together with the transfer jig. Further, in order to enhance the degasing effects of the face plate, a process may be conducted such as a cleaning process using electron beam irradiation for carrying out cleaning by irradiating electron beams while scanning is carried out.

The respective processes are now briefly described in the following. After moving the hot plates 704 and 703 to under and over the face plate 702 and rear plate 701, respectively, the baking is carried out at about 300° C. for an hour, before which there is a temperature rise period for about an hour and after which there is a temperature drop period for about 12 hours (FIG. 7A).

Then, the rear plate 701 and a part of the transfer jig supporting the rear plate 701 are moved upward by about 50 cm together with the upper hot plate. Then, the lid-like jig 705 is moved to the space between the rear and face plates to come in contact with the face plate. The jig is box-like. Eighteen ring-like barium getters are provided on the ceiling of the inside of the jig, which are connected to a current introduction terminal to be flashed by being heated with the current (FIG. 7B). The arrangement of the getters is predetermined such that a uniform film is formed at the thickness of about 50 nm on the face plate. Actually, current of 12 A was made to flow through the respective getters for 12 seconds to flash them in succession.

After that, the jig for the getter flash was removed from within the space between the rear and face plates and was returned to its original position. Next, the rear plate 701, a supporting jig, and the upper hot plate 703 were lowered to their original position (FIG. 7C), and the hot plate was heated to 180° C. with a temperature rise period of about one hour. After the temperature was maintained at 180° C. for about 3 hours, the jig for supporting the rear plate was gradually-lowered to impose a load of about 60 kgf/cm$^2$ between the rear and face plates. With this state maintained, the hot plates were left to cool by themselves to room temperature when the seal bonding was ended.

(Process-m1 (Packaging and Systematization))

The vacuum container formed in the above-described processes was equipped with a flexible cable, and at the same time, the ion pump was connected. The ion pump anode terminal 120 was, similarly to the case of the anode terminal 112 of an image display portion, treated with a moisture-resistant and high resistant resin (referred to as potting), and was connected to a high voltage cable. Though a high voltage cable of the image display portion was directly connected to the anode power supply 124, the high voltage cable of the ion pump was connected to the anode power supply 124 via a first resistor 125 of 1000 MΩ connected. The resistors were treated with an insulating tape or the like so as not to be shorted out with surrounding conductors. Further, when necessary, it was connected to a dedicated driver to make it go through processes for stabilizing the element characteristics such as pre-driving and aging. At this point, voltage was applied to the ion pump from the anode power supply to drive the ion pump. After that, assembly was done with a driver IC, a housing, and the like to complete the image display apparatus.

During the above-described Process-m1 and during the finished image display apparatus was driven, a microammeter was connected between the ion pump anode terminal 120 and the first resistor 125. Voltage of 10 kV was applied to the anode power supply 124 and change in the current was observed. Immediately after the voltage was applied, current of about 5 μA began to flow, and the current decreased to lower than 0.1 μA in about a minute. Voltage of about 10 kV was applied to the ion pump immediately after the voltage was applied, and the ion pump began to be actuated at once. After the ion pump was actuated, voltage according to resistive division ratio between the equivalent ion pump resistance and the series resistance was applied to the ion pump. The result indicates that the vacuum was made efficiently. After the ion pump was driven for 1000 hours r longer, although a phenomenon was observed where the current increased for a moment, the current was suppressed to be 10 μA or less. This indicates that the series resistance prevented excess current from flowing from the power supply. Further, in the image display apparatus of this embodiment, the ion pump was enclosed in a glass case connected to a rear face of the face plate with glass frit, and thus, miniaturization, lighter weight, higher reliability, and lower cost were realized.

Embodiment 2

Figure 8:
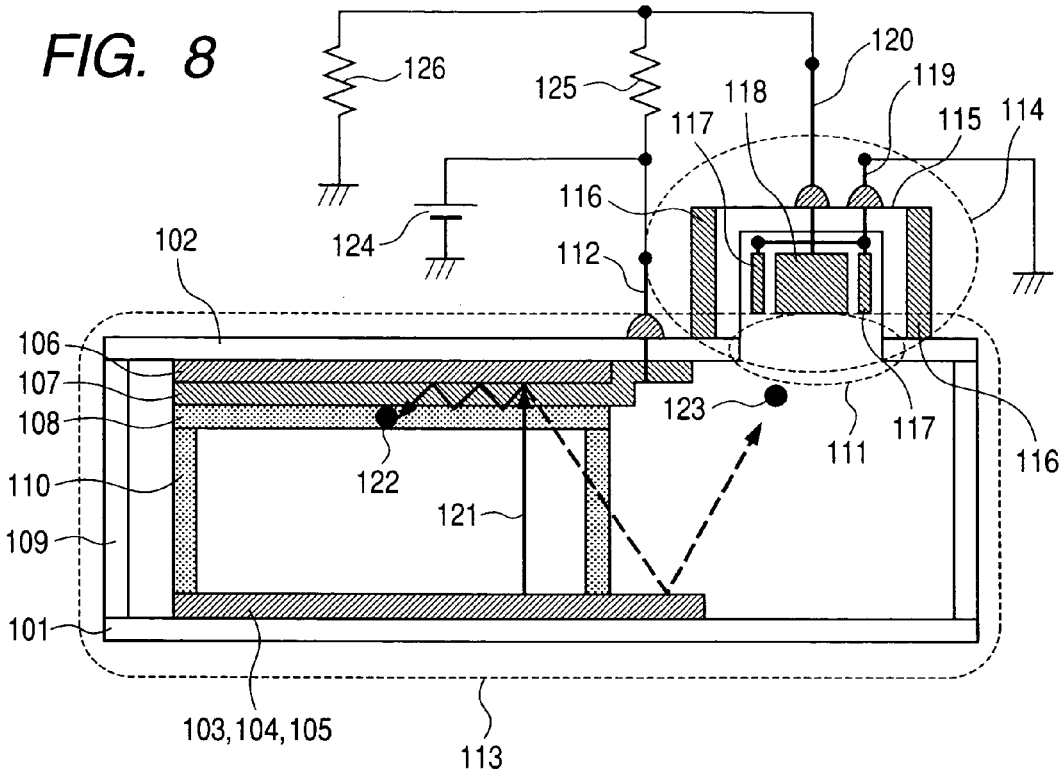
FIG. 8 is a schematic view of an image display apparatus according to an embodiment of the present invention.

This embodiment is a specific example of the second aspect of the present invention. An image display apparatus of this embodiment and a method of manufacturing the same are now described in the following with reference to FIG. 8.

(Processes-a2-a12)

Processes similar to Processes a1-j1, x1, and k1-l1 described in Embodiment 1 were carried out.

(Process-m2 (Packaging and Systematization))

The vacuum container formed in the above-described processes was equipped with a flexible cable, and at the same time, the ion pump was connected. The ion pump anode terminal 120 was, similarly to the case of the anode terminal 112 of an image display portion, treated with a moisture-resistant and high resistant resin (referred to as potting), and was connected to a high voltage cable. Though a high voltage cable of the image display portion was directly connected to the anode power supply 124, the high voltage cable of the ion pump was connected to the anode power supply 124 via a first resistor 125 of 200 MΩ connected in series. Further, a second resistor 126 of 100 MΩ was inserted before the ground in parallel with the ion pump with respect to the anode power supply 124 and the resistor 125. The resistors were treated with an insulating tape or the like so as not to be shorted out with surrounding conductors. Further, when necessary, it was connected to a dedicated driver to make it go through processes for stabilizing the element characteristics such as pre-driving and aging. At this point, voltage was applied to the ion pump from the anode power supply to drive the ion pump. After that, assembly was done with a driver IC, a housing, and the like to complete the image display apparatus.

During the above-described Process-m2 and during the finished image display apparatus was driven, a microammeter was connected between the ion pump anode terminal 120 and the resistor 125. Voltage of 10 kV was applied to the anode power supply 124 and change in the current was observed. After the voltage was applied, current of about 30 μA flowed all the time, indicating that voltage applied to the ion pump was 3.3 kV which was determined by the resistive division ratio. In other words, this indicates that the vacuum was made normally with appropriate voltage. After the ion pump was driven for more than 1000 hours, although a phenomenon was observed where the current increased for a moment, the current was suppressed to be 50 μA or less. This indicates that the series resistance prevented excess current from flowing from the power supply. In Embodiment 2, since voltage applied to the ion pump anode terminal 120 was kept to be about half as high as the anode voltage all the time, insulation at the ion pump anode terminal 120 may be less severe compared with that at the anode connection terminal 112. In the image display apparatus of this embodiment, the ion pump was also enclosed in a glass case connected to a rear face of the face plate with glass frit. Thus, miniaturization, lighter weight, higher reliability, and lower cost were realized.

Embodiment 3

While the ion pump was attached to the face plate in the above Embodiments 1 and 2, the ion pump may be attached to the rear plate. Such an embodiment is now described with reference to FIG. 9.

(Process-a3 (Glass Substrate, Element Electrode Formation))

A glass plate having an opening 112 formed therein in advance at a position illustrated in FIG. 5 was used. Cleaning and film formation were carried out in the same way as in the case of Embodiment 1.

(Processes-b3-e3)

Processes similar to Processes b1-e1 described in Embodiment 1 were carried out.

(Process-x3 (Attachment of Anode Connection Terminal and Ion Pump))

Figure 9:
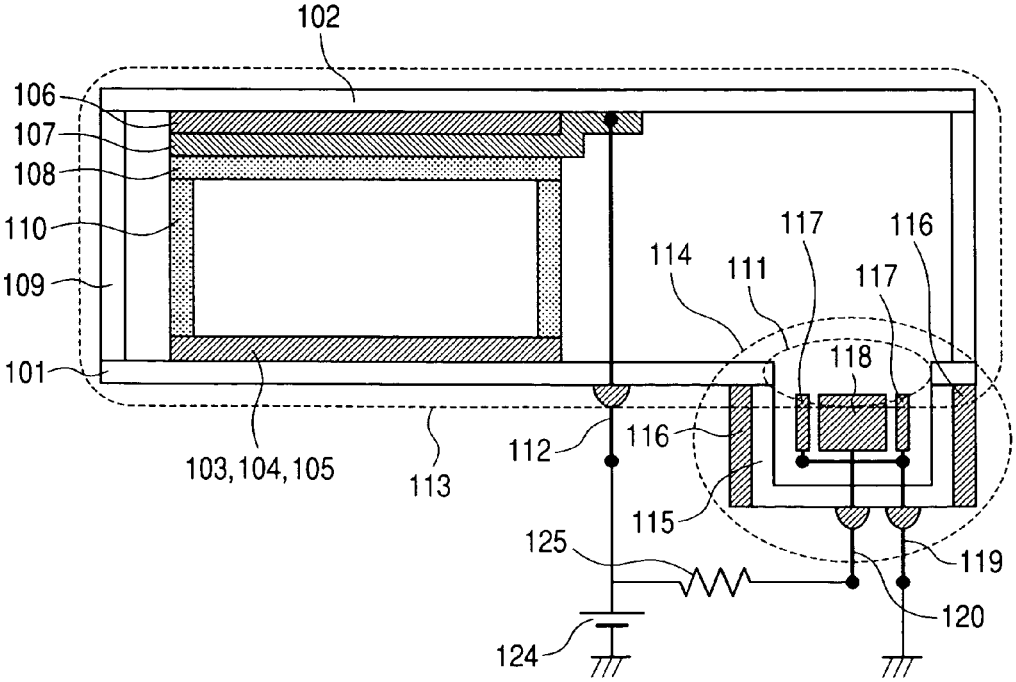
FIG. 9 is a schematic view of an image display apparatus according to an embodiment of the present invention.

First, the ion pump was assembled in the same process as that of Embodiment 1. Next, electrodes connected to the anode and the cathode of the ion pump were temporarily fixed by frit glass, and at the same time, as shown in FIG. 9 the glass case 115 of the assembled ion pump was temporarily fixed at the location of the opening for the ion pump provided in the rear plate. Further, the anode connection terminal 112 was temporarily fixed in a hole provided in the rear plate with frit glass. The rear plate with the ion pump was baked at 420° C. for an hour to form the ion pump anode terminal 120 and the ion pump cathode terminal 119, to fix the ion pump 114, and to attach the anode connection terminal 112.

(Processes-f3-i3)

Processes similar to Processes f1-i1 described in Embodiment 1 were carried out.

(Process-j3 (Face Plate Formation))

First, a glass substrate (PD-200 (manufactured by Asahi Glass Company) at the thickness of 2.8 mm) was sufficiently cleaned using a detergent, pure water, and an organic solvent. Then, silver paste was applied to an anode terminal portion (not shown), an underlayer for filling In, and the like, and baking was carried out at about 480° C. Next, a phosphor film 106 was applied by printing, the surface was smoothed (usually referred to as "filming"), and the phosphor film was completed. It is to be noted that the phosphor film 106 was a phosphor film having stripe-like phosphors (R, G, and B) and black conducting material (black stripes) arranged alternately. Further, the metal back 107 made of an Al thin film was formed at the thickness of 50 nm by sputtering on the phosphor film 106.

(Processes-k3-m3)

Processes similar to Processes b1-e1 described in Embodiment 1 were carried out.

During the above-described Process-m3 and during the finished image display apparatus was driven, a microammeter was connected between the ion pump anode terminal 120 and the resistor 125. Voltage of 10 kV was applied to the anode power supply 124 and change in the current was observed. The results obtained were substantially the same as those of Embodiment 1, and it was confirmed that the same effect was achieved. Further, in the image display apparatus of this embodiment, the ion pump was enclosed in a glass case connected to a rear face of the rear plate with glass frit, and thus, miniaturization, lighter weight, higher reliability, and lower cost were realized.

Embodiment 4

Figure 10:
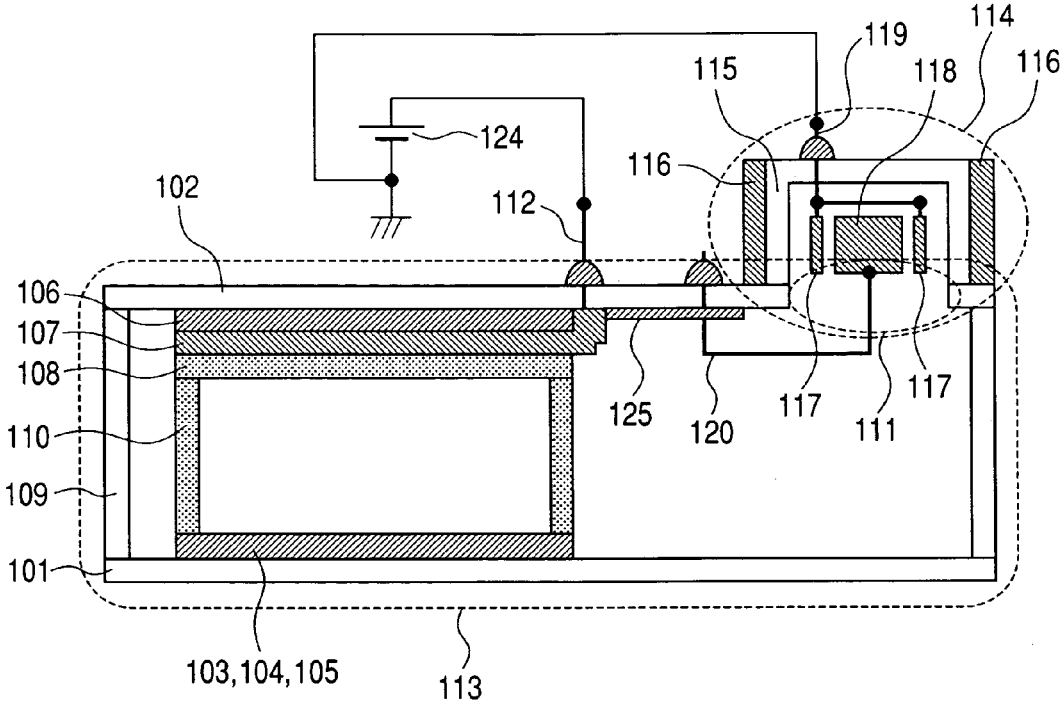
FIG. 10 is a schematic view of an image display apparatus according to an embodiment of the present invention.

While commercially available electrical resistors were used in the above-described embodiments, a high resistant thin film may be formed in the vacuum container to be used as the first resistor. Such an embodiment is now described. In this embodiment, an example where a thin film formed on the side of the face plate was used as the first resistor is described as a first aspect with reference to FIG. 10.

(Processes-a4-i4)

Processes similar to Processes a1-i1 described in Embodiment 1 were carried out.

(Process-j4 (Face Plate Formation))

First, a hole for the anode connection terminal, a hole for the ion pump anode terminal, and an opening for the ion pump were formed in a glass substrate (PD-200 (manufactured by Asahi Glass Company) at the thickness of 2.8 mm). The holes may be formed in advance by shaping the mold, or may be formed in a flat glass plate afterward. The holes are formed in an area surrounding the image display area. Next, the anode connection terminal and the ion pump anode terminal were embedded using conductive frit glass, baking was carried at 420° C. for an hour to harden the frit, and the anode connection terminal 112 and the ion pump anode terminal 120 were formed. Here, an electrode of the ion pump anode terminal penetrated the face plate. The substrate was sufficiently cleaned using a detergent, pure water, and an organic solvent. Then, silver paste was applied to patterns of a drawn line from the anode connection terminal, an underlayer for filling In, and the like, and baking was carried out at about 480° C. Next, an ethanol solution in which tin oxide particles having antimony doped therein were dispersed was sprayed to predetermined areas to form three layers. Then, baking was carried out at 380° C. for 20 minutes to form a conductive high resistant film (ATO film) as the first resistor 125.

By this, the resistance between the anode connection terminal and the ion pump anode terminal 120 became about 100 MΩ. To control the resistance more precisely, spraying may be carried out through a metal mask in a predetermined shape to define the shape of the film. Next, a phosphor film 106 was applied by printing, the surface was smoothed (usually referred to as "filming"), and the phosphor film was completed. It is to be noted that the phosphor film 106 was a phosphor film having stripe-like phosphors (R, G, and B) and black conducting material (black stripes) arranged alternately. Further, a metal back 107 made of an Al thin film was formed at the thickness of 50 nm by hot stamping.

(Process-x4 (Attachment of Ion Pump))

The structure of the ion pump illustrated is slightly different from that of Embodiment 1, so assembly of the ion pump is briefly described. When a glass case of the ion pump is manufactured, holes for anode and cathode terminals were formed at predetermined locations, where metal supports (not shown) for supporting the anode and the cathodes of the ion pump were embedded. Next, the anode and the cathodes of the ion pump were fixed by the metal supports, and electrodes were passed through the holes for the terminals to be connected to the cathodes. After that, the electrodes passing through the holes for the cathodes were temporarily fixed by frit glass, and at the same time, the assembled glass case 115 of the ion pump was temporarily fixed at the location of the opening 111 provided in the face plate. The face plate with the ion pump was baked at 420° C. for an hour to form the ion pump cathode terminal 119 and to fix the ion pump 114.

(Process-y4 (Connection Between Ion Pump Anode and Anode Terminal))

Next, a thin stainless steel plate was laid between the ion pump anode and the ion pump anode terminal 120, connection was made by spot welding, and the conductive high resistant film as the first resistor 125 and the ion pump anode were electrically connected.

(Processes-k4-m4)

Processes similar to Processes k1-m1 described in Embodiment 1 were carried out.

In Process-m4 above, only the ion pump was driven before pretreatment of the elements was carried out. At this time, a microammeter was connected between the anode power supply 124 and the anode terminal 112. Voltage of 10 kV was applied to the anode power supply 124 and change in the current was observed. The change in the current was approximately the same as that in Embodiment 1, and it was confirmed that the ion pump was driven efficiently. Also in the image display apparatus of this embodiment, the ion pump was enclosed in a glass case connected to a rear face of the face plate with glass frit. Thus, miniaturization, lighter weight, higher reliability, and lower cost were realized.

Embodiment 5

Figure 11:
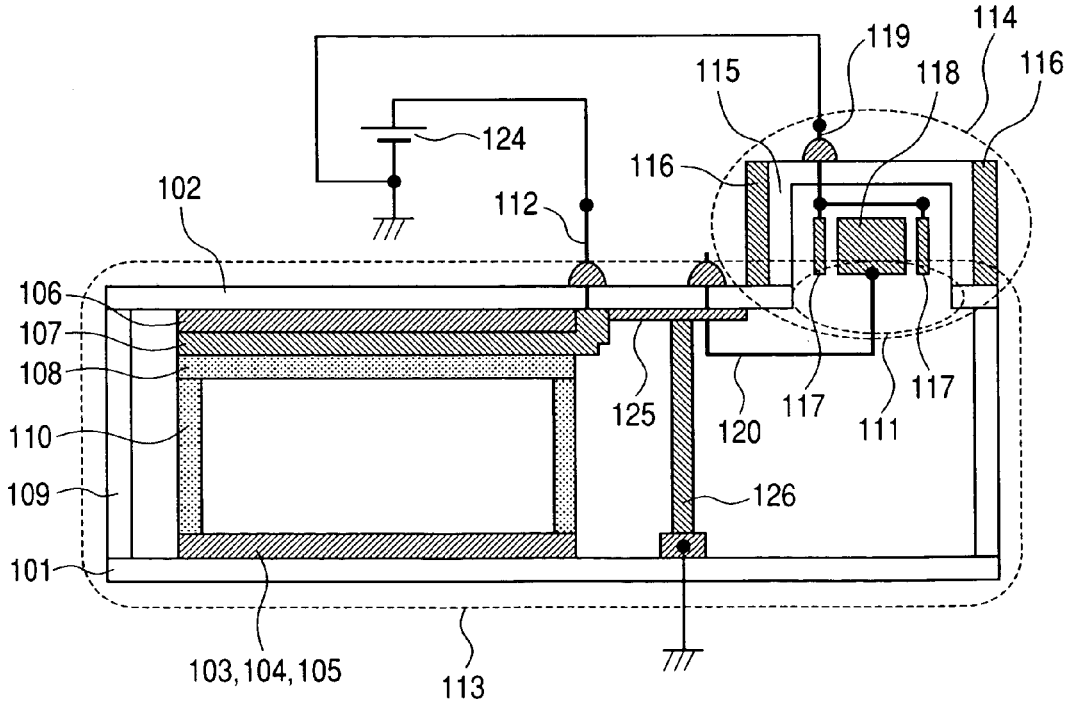
FIG. 11 is a schematic view of an image display apparatus according to an embodiment of the present invention.

In this embodiment, an example where a thin film provided in the vacuum container was used as the first and second resistors is described as a second aspect with reference to FIG. 11.

(Processes-a5-b5)

Processes similar to Processes a4-b4 described in Embodiment 1 were carried out.

(Process-c5 (Insulating Film Formation))

In order to insulate the upper wiring and the lower wirings from each other, the interlayer insulating layer is formed. The interlayer insulating layer was formed below the Y wiring (upper wiring) 324 to be described in the following such that the Y wiring covered intersections of the Y wiring 324 and the X wiring (lower wiring) 322 which was already formed, and such that electrical connection was allowed between the upper wiring (Y wiring) 324 and the other element electrode 321 with a contact hole formed at the connecting portion. It is to be noted that, in this embodiment, in addition to the structure described in Embodiment 4, an additional upper wiring was provided next to the last (768th) line of the upper wiring, and an insulating layer pattern which prevents connection to the lower wiring was added.

After photosensitive glass paste which was predominantly composed of PbO was screen printed, it was exposed to light to be developed. This was repeated four times, and at last, baking was carried out at about 480° C. The interlayer insulating layer had the thickness of about 30 μm (the total of the four layers) and the width of 150 μm.

(Process-d5 (Upper Wiring Formation))

AgO paste ink was screen printed on the previously formed insulating film and then dried, and a similar process was repeated once more to apply the Y wiring (upper wiring) 324 twice. Then, baking was carried out at about 480° C. The Y wiring 324 intersects the X wiring (lower wiring) 332 with the insulating film positioned therebetween, and is also connected to the other element electrode at the contact hole portion of the insulating film.

The other element electrode 321 was connected through this wiring, and acted as a scanning electrode after a panel was completed. It is to be noted that the 769th line was added. The Y wiring 324 had the thickness of about 15 μm. Although not shown in the figure, a drawn terminal to an external driving circuit was formed in a similar way. In this way, a substrate having XY matrix wiring was formed.

(Processes-e5-h5)

Processes similar to Processes e4-h4 described in Embodiment 4 were carried out.

(Process-i5 (Spacer Placement))

As illustrated in FIG. 5, the spacers 110 were provided on a part of the lines (Nos. 5, 45, 85, 125, 165, 205, 245, 285, 325, 365, 405, 445, 485, 525, 565, 605, 645, 685, 725, and 765) of the Y wiring (upper wiring) of the electron source substrate 101. The spacers were fixed outside the area with elements (pixel area) using a ceramic adhesive (Aron Ceramic W manufactured by TOAGOSEI CO., LTD.) with an insulating stage (a thin plate glass) 515 used as a support. In this embodiment, an extra spacer (the second resistor 126) was provided on the 769th line. An ATO (antimony tin oxide) film was applied only to this spacer on the whole surface to make the vertical resistance 100 MΩ.

(Process-j5 (Face Plate Formation))

The face plate was formed in an approximately similar way as in Process-j4 of Embodiment 4. It is to be noted that the solution in which tin oxide particles were dispersed was sprayed to form four layers, and the area was larger to form the conductive high resistant film (ATO film) as the first resistor 125 such that its resistance was 200 MΩ. It is to be noted that silver paste was applied not only to the anode connection terminal and an underlayer for filling In, but also to a contact portion of the ion pump terminal 120 and the spacer with ATO (the second resistor 126).

Processes-x5, y5, k5, and 15

Processes similar to Processes x4, y4, k5, and l5 described in Embodiment 4 were carried out. In these processes, as illustrated in FIG. 11, the conductive high resistant film (the first resistor 125) and the spacer with the high resistant film formed thereon (the second resistor 126) came in contact with each other, and electrical connection was made between the two and the ion pump anode.

(Process-m5 (Packaging and Systematization)

The vacuum container formed in the above-described processes was equipped with a flexible cable. The terminal 112 of the image display portion was potted and was connected to a high voltage cable. The high voltage cable was connected to the anode power supply 124. The upper wiring on which the spacer 126 with the ATO film applied thereto was mounted was directly grounded. As a result, while the output voltage of a high voltage power supply was applied to the image display-portion anode 107 as it was, voltage divided by the high resistant conductive film 125 and the resistance of the ATO film of the spacer 126 was applied to the ion pump anode. When necessary, the element was connected to a dedicated driver to make it go through processes for stabilizing the element characteristics such as pre-driving, aging, and the like. At this time, the ion pump was driven and the processes for stabilizing the element characteristics were conducted under good vacuum conditions. After these processings were ended, assembly was done with a driver IC, a housing, and the like to complete the image display apparatus.

In Process-m5 above, in the same way as in Embodiment 4, the ion pump was driven before pretreatment of the elements was carried out. Further, in the same way as in Embodiment 4, a microammeter was connected between the anode power supply 124 and the anode terminal 112, and voltage of 10 kV was applied to the anode power supply 124 and change in the current was observed. The change in the current was approximately the same as that in Embodiment 2, indicating that voltage of 3.3 kV was applied to the ion pump, and the vacuum was made normally. After the ion pump was driven for more than 1000 hours, although a phenomenon was observed where the current increased for a moment, the current was suppressed to be 50 μA or less. This indicates that the series resistance prevented excess current from flowing from the power supply. Also in the image display apparatus of this embodiment, also, the ion pump was enclosed in a glass case connected to a rear face of the face plate with glass frit. Thus, miniaturization, lighter weight, higher reliability, and lower cost were realized.

Embodiment 6

Figure 12:
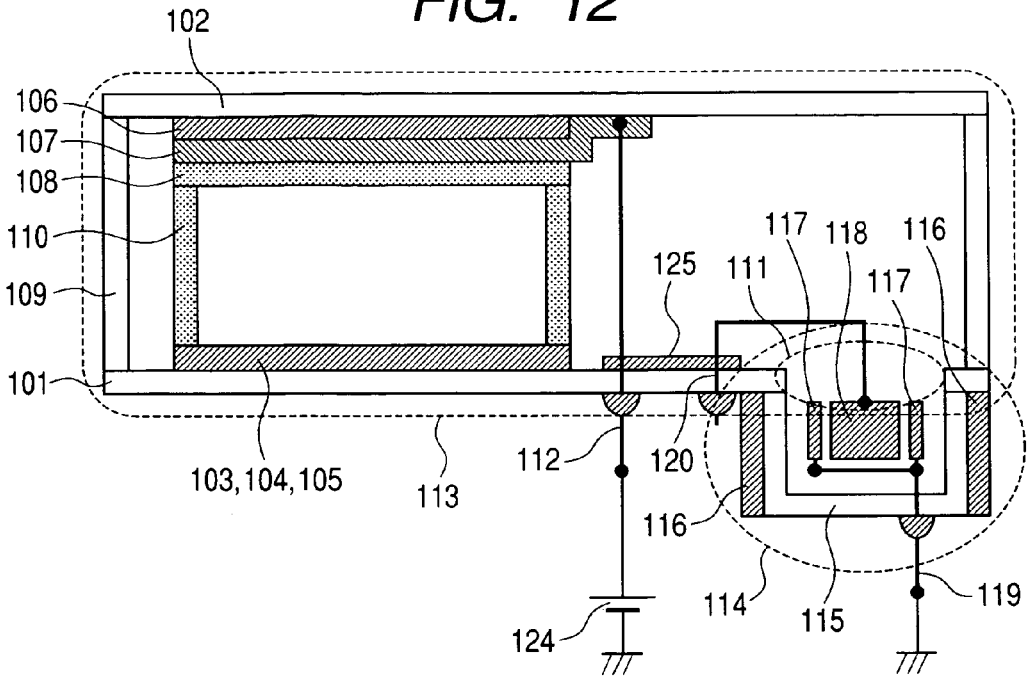
FIG. 12 is a schematic view of an image display apparatus according to an embodiment of the present invention.

Although, in Embodiment 4, the first resistor of the first aspect was provided on the side of the face plate, as illustrated in FIG. 12, in the first aspect, the first resistor may be provided on the side of the rear plate. This is a structure which combines Embodiment 3 (FIG. 9) and Embodiment 4 (FIG. 10), and thus, a method of manufacturing the same is omitted.

Embodiment 7

While, in Embodiment 5, a thin film formed on the face plate was used as the first resistor and a thin film formed on the surface of a spacer was used as the second resistor in the second aspect, in this embodiment, a thin film formed on the rear plate was used as the first and the second resistors.

Figure 13:
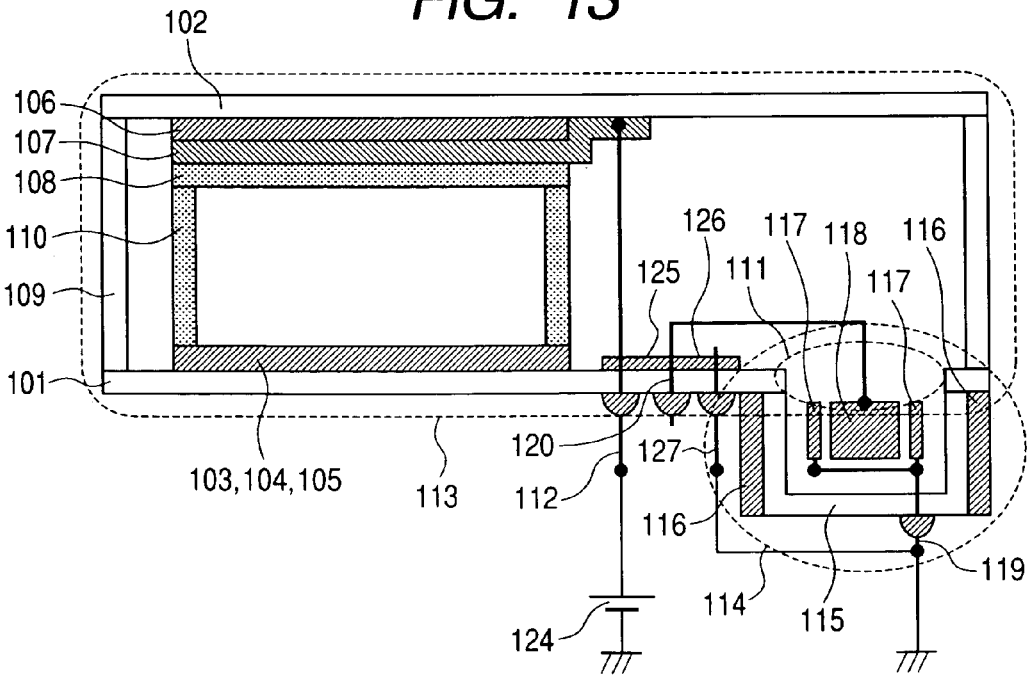
FIG. 13 is a schematic view of an image display apparatus according to an embodiment of the present invention.

As illustrated in FIG. 13, this embodiment is the same as Embodiment 3 in that the anode power supply was connected to the anode connection terminal 112 provided on the side of the rear plate and was connected to the metal back 107 on the face plate. In this embodiment, the high resistant film provided on the face plate in Embodiment 5 was provided on the rear plate. The high resistant film and the anode connection terminal 112 were electrically connected, and the high resistant film was divided and used as the first resistor 125 and the second resistor 126. More specifically, as illustrated in FIG. 13, a relay terminal 127 was provided which was connected to the high resistant film around an end opposite to an end where the anode connection terminal was connected. The relay terminal 127 was grounded. The ion pump anode terminal 120 was provided around a center location, and the ion pump anode terminal 120 was connected to the ion pump anode 118 by a thin stainless steel plate. The high resistant film was divided into the first resistor 125 and the second resistor 126. While the first resistor was connected in series with the ion pump, the second resistor was connected in parallel with the ion pump. A method of manufacturing the image display apparatus is a combination of the above description, and thus, description thereof is omitted here.

It is to be noted that the method of dividing the thin film to be used as the first and second resistors as described in this embodiment can be applied to a high resistant film provided on the face plate. In that case, the high resistant film provided on the surface of the spacer used in Embodiment 5 (FIG. 11) may not be used.

Embodiment 8

Figure 14:
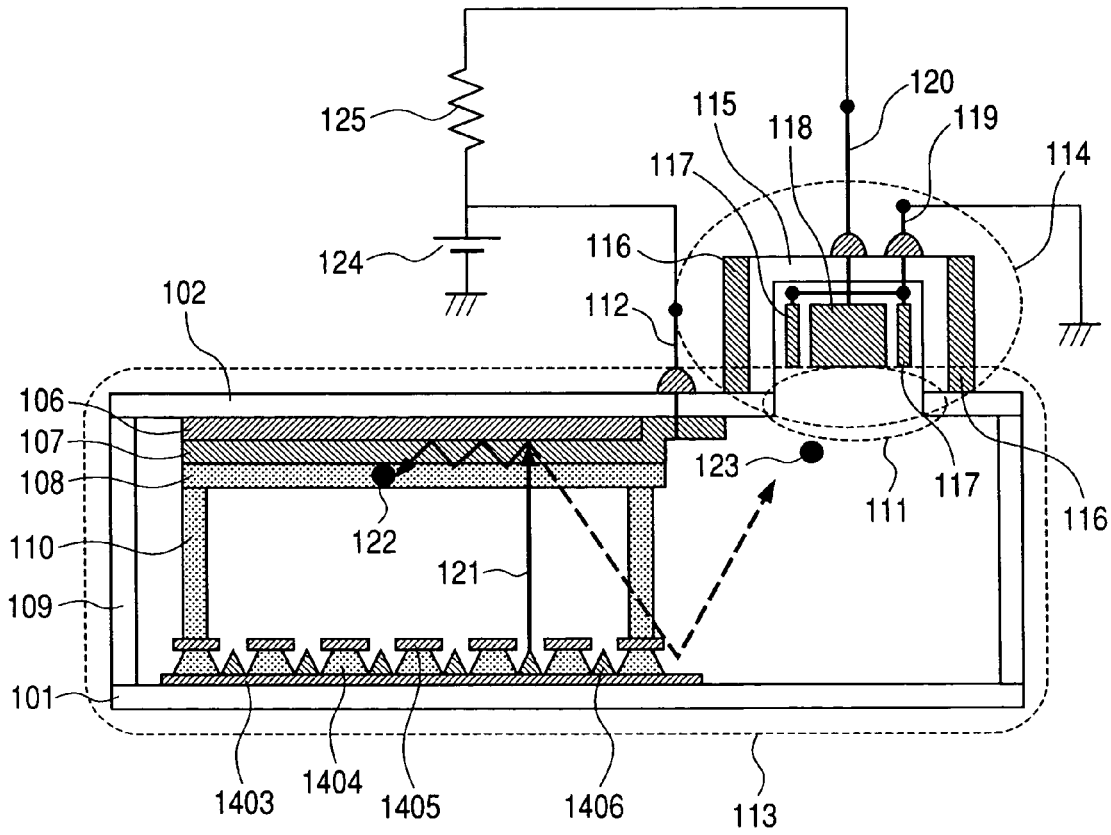
FIG. 14 is a schematic view of an image display apparatus according to an embodiment of the present invention where Spindt type electron emitting elements are used.

Next, an example where different electron emitting elements were used is described with reference to FIG. 14.

(Process-a8 (Cathode Formation))

First, a PD-200 (manufactured by Asahi Glass Co., Ltd.) glass substrate at the thickness of 2.8 mm was sufficiently cleaned. An Mo film at the thickness of 0.25 μm was formed on the glass substrate by sputtering, and cathode electrodes (1403) which-also served as the X wiring were formed using ordinary photolithographic techniques.

(Process-b8 (Insulating Layer and Gate Formation))

An $SiO_2$ film (1404) at the thickness of 1 μm was formed on that by sputtering, and subsequently, an Mo film at the thickness of 0.25 μm was formed. After that, a hole which was 1.5 μm in diameter was formed in the Mo and $SiO_2$ films using ordinary photolithographic techniques to form gate electrodes (1405) which also served as the Y wiring and emitter forming holes.

(Process-c8 (Emitter Formation))

Next, an $SiO_2$ film at the thickness of 1.5 μm was formed on that by sputtering, and etching back was performed by 1.2 μm. Then, W at the thickness of 1 μm was formed and the remaining $SiO_2$ at the thickness of 0.3 μm was lifted off to form conical emitter electrodes (1406).

(Process-d8 (Attachment of Supporting Frame))

This process was carried out similarly to Process-h1 in Embodiment 1.

(Process-e8 (Spacer Placement))

This process was similar to Process-i1 in Embodiment 1. This formed a rear plate having Spindt type electron emitting elements arranged thereon.

(Process-f8 (Face Plate Formation))

This process was carried out similarly to Process-j1 in Embodiment 1.

(Process-x8 (Attachment of High Voltage Introduction Terminal and Ion Pump))

This process was carried out similarly to Process-x1 in Embodiment 1.

(Process-g8 (Application of In))

This process was carried out similarly to Process-k1 in Embodiment 1.

(Process-h8 (Degasing, Getter Flash, and Seal-bonding))

This process was carried out similarly to Process-l1 in Embodiment 1.

(Process-i8 (Packing and Systematization))

This process was carried out similarly to Process-m1 in Embodiment 1.

During the above-described Process-i8 and during the finished image display apparatus was driven, a microammeter was connected between the ion pump anode terminal 120 and the resistor 125. Voltage of 10 kV was applied to the anode power supply 124 and change in the current was observed. The result confirms that substantially the same behaviors as those of Embodiment 1 are observed and the same effects are obtained. Further, in the image display apparatus of this embodiment too, the ion pump was enclosed in a glass case connected to a rear face of the face plate with glass frit, and thus, miniaturization, lighter weight, higher reliability, and lower cost were realized.

Comparative Example 1

In Comparative example 1, the same process as that of Embodiment 1 is performed except that the first resistor in Embodiment 1 was not used. More specifically, Process-m1 in Embodiment 1 was replaced by the following Process-M1.

(Process-M1 (Packaging and Systematization))

The vacuum container formed before Process-m1 was equipped with a flexible cable, and at the same time, the ion pump was connected. The ion pump anode terminal 120 was, similarly to the case of the anode terminal 112 of an image display portion, treated with a moisture-resistant and high resistant resin (referred to as potting), and was connected to a high voltage cable. Though a high voltage cable of the image display portion was directly connected to the anode power supply 124, the high voltage cable of the ion pump was directly connected to the anode power supply 124. Further, when necessary, it was connected to a dedicated driver to make it go through processes for stabilizing the element characteristics such as pre-driving, aging, and the like. At that point, voltage was applied to the ion pump from the anode power supply to drive the ion pump. After that, assembly was done with a driver IC, a housing, and the like to complete the image display apparatus.

During the above-described Process-M1 and during the driving of the finished image display apparatus, a microammeter was connected between the ion pump anode terminal 120 and the anode power supply 124. Voltage of 5 kV was first applied to the anode power supply 124 and a change in the current was observed. When the ion pump was actuated, the current decreased approximately exponentially, and the current after one minute passed was 5 times as much as that in Embodiment 1. This indicates that the exhausting rate after the ion pump was actuated was low. Then, voltage of 10 kV was applied. After the ion pump was driven for a long time, a large current in excess of 1 mA frequently flowed. This phenomenon places a significant burden on the anode power supply, which may have an adverse effect on a driver for image display.

Comparative Example 2

In Comparative Example 2, the same process as that of Embodiment 8 is performed except that the first resistor in Embodiment 8 was not used. More specifically, Process-i8 (packaging and systematization) in Embodiment 8 was replaced by Process-M1 in Comparative Example 1, and an image display apparatus was manufactured.

The result was that the same phenomenon as that in Comparative Example 1 was observed during the process corresponding to the above-described Process-M1 and during the driving of the finished image display apparatus was driven.

As described in the above, in the embodiments, compared with the comparative examples, the ion pump was actuated with more stability, and there was less adverse effect on the power supply and the peripheral circuit, and thus, when the image display apparatus was driven and changes in brightness was compared, the brightness in Comparative Examples 1 and 2 was unstable, while the brightness in Embodiments 1 to 8 were stable with less variation over time. Further, the ion pump was enclosed in the glass case connected to the rear face of the face plate or the rear plate with glass frit, whereby miniaturization, lighter weight, higher reliability and lower cost can be realized.

This application claims priority from Japanese Patent Application No. 2004-248546 filed Aug. 27, 2004, which is hereby incorporated by reference herein.

What is claimed is:

1. An image display apparatus, comprising at least:

a vacuum container including an electron source and an anode electrode opposing the electron source, the vacuum container being kept under a reduced pressure;

an anode power supply for applying voltage to the anode electrode;

an ion pump provided to communicate with the vacuum container; and a first resistor connected in series with the ion pump with respect to a power supply for driving the ion pump.

2. An image display apparatus according to claim 1, wherein the power supply for driving the ion pump is the anode power supply.

3. An image display apparatus according to claim 1, wherein a resistance (R1) of the first resistor is 0.05 to 20 times as large as a resistance (Ripm) of the ion pump under normal operation.

4. An image display apparatus according to claim 1, wherein the first resistor is provided outside the vacuum container.

5. An image display apparatus according to claim 1, wherein the first resistor is a thin film formed in the vacuum container.

6. An image display apparatus according to claim 1, wherein the vacuum container comprises:

an electron source substrate having a plurality of electron emitting elements arranged thereon as the electron source; and an image forming substrate provided correspondingly to the electron source substrate and having a phosphor film and an anode electrode film as the anode electrode.

7. An image display apparatus according to claim 6, wherein the first resistor is a thin film provided on at least one of the electron source substrate and the image forming substrate in the vacuum container.

8. An image display apparatus, comprising at least:

a vacuum container including an electron source and an anode electrode opposing the electron source, the vacuum container being kept under a reduced pressure;

an anode power supply for applying voltage to the anode electrode;

an ion pump provided to-communicate with the vacuum container;

a first resistor connected in series with the ion pump with respect to a power supply for driving the ion pump; and a second resistor connected in parallel with the ion pump with respect to the power supply for driving the ion pump.

9. An image display apparatus according to claim 8, wherein the power supply for driving the ion pump is the anode power supply.

10. An image display apparatus according to claim 8, wherein:

a resistance (R2) of the second resistor is within 0.01 to 1 time as large as a resistance (Ripm) of the ion pump under normal operation; and a resistance (R1) of the first resistor is within 0.5 to 10 times as large as the resistance (R2) of the second resistor.

11. An image display apparatus according to claim 8, wherein the first resistor and the second resistor are provided outside the vacuum container.

12. An image display apparatus according to claim 8, wherein the first resistor and the second resistor are a thin film formed in the vacuum container.

13. An image display apparatus according to claim 8, wherein the vacuum container comprises:

an electron source substrate having a plurality of electron emitting elements arranged thereon as the electron source; and an image forming substrate provided correspondingly to the electron source substrate and having a phosphor film and an anode electrode film as the anode electrode.

14. An image display apparatus according to claim 13, wherein at least one of the first resistor and the second resistor is a thin film provided on at least one of the electron source substrate and the image forming substrate in the vacuum container.

15. An image display apparatus according to claim 13, wherein at least one of the first resister and the second resistor is a thin film provided on a side of a spacer disposed between the electron source substrate and the image forming substrate.

16. An image display apparatus according to claim 13, wherein the first resistor and the second resistor are formed by electrically connecting a thin film, which is provided on at least one of the electron source substrate and the image forming substrate in the vacuum container, to the anode power supply, an anode of the ion pump, and a ground in a stated order.

* * * * *

UNITED STATES PATENT AND TRADEMARK OFFICE

CERTIFICATE OF CORRECTION

PATENT NO. : 7,279,846 B2
APPLICATION NO. : 11/205050
DATED : October 9, 2007
INVENTOR(S) : Ihachiro Gofuku et al.

It is certified that error appears in the above-identified patent and that said Letters Patent is hereby corrected as shown below:

COLUMN 2:

Line 39, “during” should read --during which--.

COLUMN 3:

Line 55, “a” should be deleted.

COLUMN 5:

Line 22, “suppresses.” should read --suppressed.--.

COLUMN 10:

Line 34, “200-311599,” should read --2000-311599,--.

COLUMN 13:

Line 15, “gradually-lowered” should read --gradually lowered--; and
Line 58, “r” should read --or--.

COLUMN 18:

Line 47, “display-portion” should read --display portion--.

COLUMN 20:

Line 3, “which-also” should read --which also--.

COLUMN 22:

Line 42, “to-communicate” should read --to communicate--.

UNITED STATES PATENT AND TRADEMARK OFFICE

CERTIFICATE OF CORRECTION

PATENT NO. : 7,279,846 B2
APPLICATION NO. : 11/205050
DATED : October 9, 2007
INVENTOR(S) : Ihachiro Gofuku et al.

It is certified that error appears in the above-identified patent and that said Letters Patent is hereby corrected as shown below:

COLUMN 23:

Line 15, "resister" should read --resistor--.

Signed and Sealed this

Tenth Day of June, 2008

JON W. DUDAS
*Director of the United States Patent and Trademark Office*